US005314015A

United States Patent [19]

Streich et al.

[11] Patent Number: 5,314,015

[45] Date of Patent: May 24, 1994

[54] STAGE CEMENTER AND INFLATION PACKER APPARATUS

[75] Inventors: Steven G. Streich; John T. Brandell; Richard L. Giroux, all of Duncan; Lee W. Stepp, Comanche, all of Okla.

[73] Assignee: Halliburton Company, Duncan, Okla.

[21] Appl. No.: 923,735

[22] Filed: Jul. 31, 1992

[51] Int. Cl.[5] ..... E21B 33/127; E21B 34/14

[52] U.S. Cl. ..... 166/184; 166/154; 166/187; 166/318; 166/332

[58] Field of Search ..... 166/187, 184, 318, 332, 166/289, 154

[56] References Cited

U.S. PATENT DOCUMENTS

| | | | |
|---|---|---|---|
| 2,435,016 | 1/1948 | Pitts | 166/1 |
| 3,053,322 | 9/1962 | Kline | 166/318 X |
| 3,148,731 | 9/1964 | Holden | 166/318 X |
| 3,524,503 | 8/1970 | Baker | 166/187 X |
| 3,527,299 | 9/1970 | Lewis | 166/184 |
| 3,768,556 | 10/1973 | Baker | 166/154 |
| 3,811,500 | 5/1974 | Morrisett et al. | 166/154 |
| 3,948,322 | 4/1976 | Baker | 166/289 |
| 4,421,165 | 12/1983 | Szarka | 16/187 X |
| 5,024,273 | 6/1991 | Coone et al. | 166/289 |
| 5,038,862 | 8/1991 | Giroux et al. | 166/289 |
| 5,109,925 | 5/1992 | Stepp et al. | 166/184 |

OTHER PUBLICATIONS

Bakerline 1982–1983 Product Service Catalog—Stage and Stab-In Cementing Equipment and Services BL-482.

Baker Oil Tools, Baker Eastern Division 1978–79 Catalog.

Brochure entitled HOS Cementer, undated.

*Primary Examiner*—Hoang C. Dang

*Attorney, Agent, or Firm*—James R. Duzan; Neal R. Kennedy

[57] ABSTRACT

A stage cementer and inflation packer apparatus. The apparatus comprises a mandrel with an external closing sleeve and an operating sleeve interlocked therewith. Below the operating sleeve is an opening sleeve. The opening sleeve is mechanically acutated by a pump-down plug in a plug-operated embodiment or by a differential pressure acting on the opening sleeve in a hydraulically operated embodiment, to actuate the opening sleeve to allow inflation of the packer element. A back check valve prevents the packer from deflating. After the packer is inflated, additional pressure is applied which ruptures a rupture disc to open a port to the well annulus above the set packer element. Cementing may be carried out through this port, and after the cementing operating, a plug engages the operating sleeve to move the operating sleeve in the external closure sleeve, thereby closing the cementing port. After cementing is complete, the center components of the apparatus may be drilled out, leaving the external closure sleeve to permanently seal the cementing port.

44 Claims, 8 Drawing Sheets

STAGE CEMENTER AND INFLATION PACKER APPARATUS

BACKGROUND OF THE INVENTION

1. Field Of The Invention

This invention relates to apparatus used in downhole cementing of well casing, and more particularly, to a stage cementer and inflation packer combination which allows cementing above the packer after setting thereof.

2. Description Of The Prior Art

In preparing oil well boreholes for oil and/or gas production, a most important step involves the process of cementing. Basically, oil well cementing is the process of mixing a cement-water slurry and pumping it down through steel casing to critical points located in the annulus around the casing, in the open hole below, or in fractured formations.

Cementing a well protects possible production zones behind the casing against salt water flow and protects the casing against corrosion from subsurface mineral waters and electrolysis from outside. Cementing also eliminates the danger of fresh drinking water and recreational water supply strata from being contaminated by oil or salt water flow through the borehole from formations containing these substances. It further prevents oil well blowouts and fires caused by high pressure gas zones behind the casing and prevents collapse of the casing from high external pressures which can build up under ground.

A cementing operation for protection against the abovedescribed downhole condition is called primary cementing. Secondary cementing includes the cementing processes used in a well during its productive life, such as remedial cementing and repairs to existing cemented areas. The present invention is generally useful in both primary and secondary or remedial cementing. In the early days of oil field production, when wells were all relatively shallow, cementing was accomplished by flowing the cement slurry down the casing and back up the outside of the casing in the annulus between the casing and the borehole wall.

As wells were drilled deeper and deeper to locate petroleum reservoirs, it became difficult to successfully cement the entire well from the bottom of the casing, and, therefore, multiple stage cementing was developed to allow the annulus to be cemented in separate stages, beginning at the bottom of the well and working upwardly.

Multiple stage cementing is achieved by placing cementing tools, which are primarily valved ports, in the casing or between joints of casing at one or more locations in the borehole; flowing cement through the bottom of the casing, up the annulus to the lowest cementing tool in the well; closing off the bottom and opening the cementing tool; and then flowing cement through the cement tool up the annulus to the next upper stage, and repeating this process until all of the stages of cementing are completed.

Some prior art cementing tools used for multi-stage cementing have two internal sleeves, both of which are shear-pinned initially in an upper position, closing the cementing ports in the tool. To open the cementing ports, a plug is flowed down the casing and seated on the lower sleeve. Fluid pressure is then increased in the casing until sufficient force is developed on the plug and sleeve to shear the shear pins and move the lower sleeve to the position uncovering the cementing ports. Cement is then flowed down the casing and out the ports into the annulus. When the predetermined desired amount of cement has been flowed into the annulus, another plug is placed in the casing behind the cement and flowed down the casing to seat on the upper sleeve. The pressure is increased on the second plug until the shear pins holding it are severed and the upper sleeve is moved down to close the cementing ports. One such cementing tool of this type is disclosed in Baker U.S. Pat. No. 3,768,556, assigned to the assignee of the present invention.

One improvement on the Baker '556 device is found in Jessup et al. U.S. Pat. No. 4,246,968, and also assigned to the assignee of the present invention. The Jessup et al. '968 patent discloses a device similar to that of the Baker '556 patent, except it has added a protective sleeve which covers some of the internal areas of the tool which are otherwise exposed when the internal sleeve is moved downward to close the port. This protective sleeve prevents other tools, which may be later run through the cementing tool, from hanging up on the inner bore of the cementing tool.

Another approach which has been utilized for cementing tools is to locate the closure sleeve outside the housing of the tool. One such line of tools is distributed by the Bakerline Division of Baker Oil Tools, Inc., known as the Bakerline Model "J" and Model "G" stage cementing collars. These closure sleeves have a differential area defined thereon and are hydraulically actuated in response to internal casing pressure which is communicated with the sleeves by movement of an internal operating sleeve to uncover a fluid pressure communication port.

An external sleeve cementing tool which uses a mechanical inner locking means between an inner operating sleeve and an outer closure sleeve is disclosed in Giroux et al. U.S. Pat. No. 5,038,862, assigned to the assignee of the present invention. This external sleeve cementing tool is particularly useful in completing stage cementing of slim hole oil and gas wells. Slim hole completions involve using casing inside relatively small hole sizes to reduce the cost of drilling the well. In other words, the well annulus between the borehole and the casing is relatively small.

There are cementing applications which necessitate the sealing off of the annulus between the casing string and the wall of the borehole at one or more positions along the length of the casing string. An example of such an application is when it is desired to achieve cementing between a high pressure gas zone and a lost circulation zone penetrated by the borehole. Another application is when it is desired to achieve cementing above a lost circulation zone penetrated by the borehole. A third application occurs when the formation pressure of an intermediate zone penetrated by the borehole is greater than the hydrostatic head of the cement to be placed in the annulus thereabove. Still another application occurs when a second stage of cement is to be placed at a distant point up the hole from the top of the first stage of cement, and a packer is required to further support the cement column in the annulus. A further example of an application for employment of the cementing packer occurs when it is desired to achieve full hole cementing of slotted or perforated liners.

An example of such an inflatable packer for cementing is the multi-stage inflatable packer disclosed in Baker U.S. Pat. No. 3,948,322, assigned to the assignee of the present invention. In this device, an opening plug is dropped into the casing string and pumped down to actuate an opening sleeve to allow inflation of the packer element. A back check valve prevents the packer from deflating. After the packer is inflated, additional pressure is applied which moves an annular valve member to open a port in the well annulus above the inflated packer element. In a later version of this apparatus, a thin-walled secondary opening sleeve is sheared to open this port.

The secondary opening sleeve, being essentially a thin-walled mandrel, is difficult to manufacture. Further, when the tool is positioned in the well bore, there may be some bending of the tool which can cause the annular valve member or secondary opening sleeve to bind and not open as desired. This problem is addressed Stepp et al. in U.S. Pat. No. 5,109,925, also assigned to the assignee of the present invention, in which the annular valve member or secondary opening sleeve is replaced by a secondary rupture disc which is designed to burst or rupture at the predetermined pressure.

The present invention combines the advantages of the external sleeve cementing tool of Giroux et al. '862 with the inflation packer of Stepp et al. '925. Copies of these two patents are incorporated herein by reference. Thus, the present invention is well adapted for use in slim hole completions in those applications which necessitate the sealing off of the annulus between the casing string and the borehole, as described above.

SUMMARY OF THE INVENTION

The stage cementer and inflation packer apparatus of the present invention generally comprises a mandrel or housing having an inner passage defined therethrough and having an outer surface, inflatable packing means connected to the mandrel for sealingly engaging the well bore, inflation passage means for providing communication between the inner passage and the mandrel and the packing means when opened, an opening sleeve slidably received in the mandrel and movable between a closed position wherein the inflation passage means is closed and an open position wherein the inflation passage means is open, and a pressure relief means upstream of the packing means for opening in response to a predetermined pressure after inflation of the packing means and thereby placing the inner passage in the mandrel in communication with the well annulus. The apparatus further comprises an outer closure sleeve slidably received about the outer surface of the mandrel and movable between an open position wherein the pressure relief means provides communication between the inner passage and the well annulus when the pressure relief means is open and a closed position wherein communication between the inner passage and the well annulus is prevented, an inner operating sleeve slidably received in the mandrel and movable between first and second positions relative to the mandrel, an interlocking means operably associated with both the operating sleeve and closure sleeve for transferring a closing force from the operating sleeve to the closure sleeve and thereby moving the closure sleeve to its closed position as the operating sleeve moves from its first position to its second position.

In one embodiment, the inflation passage means comprises a port defined through a wall of the mandrel. The port may be aligned with the pressure relief means.

In another embodiment, the inflation passage means comprises a slot defined in the opening sleeve.

The pressure relief means may comprise rupture means for rupturing in response to a predetermined pressure. Thus the rupture means may be characterized by a rupture disc.

In one embodiment, the pressure relief means is disposed in a port defined in the outer closure sleeve. In another embodiment, the pressure relief means is disposed in a port defined in the mandrel.

The apparatus may further comprise a housing, and at least a portion of the outer closure sleeve may be slidably received in the housing. This housing may be characterized by a portion of the mandrel or by a portion of the inflatable packing means. In one embodiment, the housing defines a housing or body port therein, and the pressure relief means is disposed in the housing port.

In one embodiment, the mandrel comprises an upper mandrel, a lower mandrel, and connecting means for interconnecting the upper and lower mandrels. The connecting means may be characterized by a mandrel coupling. In this embodiment, preferably the opening sleeve is slidably received in the upper mandrel, the outer closure sleeve is slidably received about the upper mandrel, the inner operating sleeve is slidably received in the upper mandrel, and the inflatable packing means is disposed about the lower mandrel. The lower mandrel and inflatable packing means may be one set of a plurality of such interchangeable sets of lower mandrels and inflatable packing means.

In the preferred embodiment, the mandrel defines a slot therein, and the interlocking means is a mechanical interlocking means comprising a pin extending through the slot and fixedly connected to both the outer closure sleeve and the inner operating sleeve.

Check valve means may be provided between the inflation passage means and the inflatable packing means for allowing movement of fluid to the packing means while preventing deflation thereof.

The apparatus may further comprise pressure equalizing means for equalizing pressure on an inside portion of the pressure relief means and a well annulus.

In plug-operated embodiments, the opening sleeve is moved from its closed to its open position by a pump-down plug. In hydraulically operated embodiments, the opening sleeve defines a differential pressure area thereon, and a predetermined pressure is applied across the differential pressure area which moves the opening sleeve from its closed position to its open position.

In one embodiment, a retainer ring is carried by the closure sleeve, and downward movement of the closure sleeve is terminated by engagement of the retainer ring with a retainer ring groove defined in the mandrel.

In one embodiment, the mandrel defines an inflation port and a cementing port therein, and the inflatable packing means is in communication with the inflation port. When the opening sleeve is in its closed position, communication between the inflatable packing means and the inner passage of the mandrel through the inflation port is prevented, and when the opening sleeve is in its open position, the inflatable packing means and the inner passage are in communication through the inflation port. In this embodiment, the pressure relief means is disposed in the cementing port. The cementing port is covered on an inner side thereof by the opening sleeve when in its closed position and uncovered on its inner side when the opening sleeve is in its open position.

In this latter embodiment, the mandrel preferably defines a recess therein, and the opening sleeve defines a slot therein in communication with the recess and the inflation port. Communication between the inner passage of the mandrel and the recess is prevented when the opening sleeve is in its closed position, and the inner passage and recess are in communication when the opening sleeve is in its open position.

Pressure equalizing means may be disposed in another port defined in the mandrel.

Numerous objects, features and advantages of the invention will become apparent when the following detailed description of the preferred embodiments is read in conjunction with the drawings which illustrate such preferred embodiments.

DESCRIPTION OF THE PREFERRED EMBODIMENTS

First Embodiment

Figure 1A:
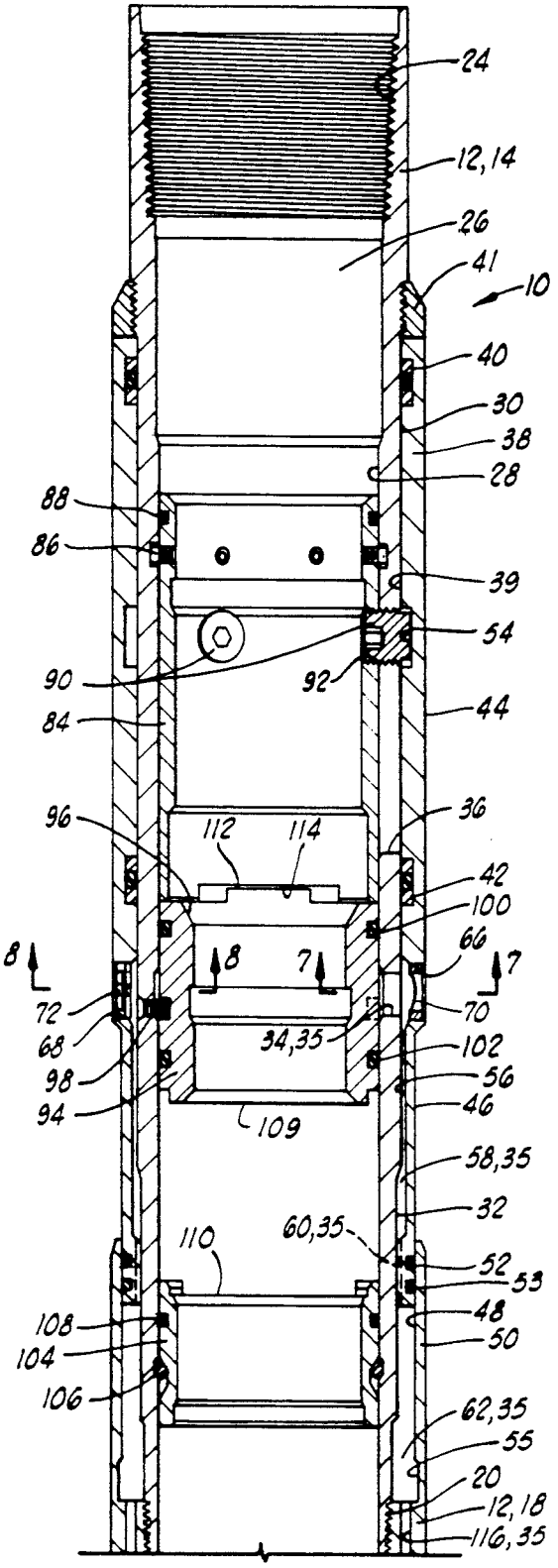
FIGS. 1A-1C show a longitudinal cross section of a first preferred embodiment of the stage cementer and inflation packer apparatus of the present invention utilizing a plug actuated lower internal opening sleeve.
Figure 1B:
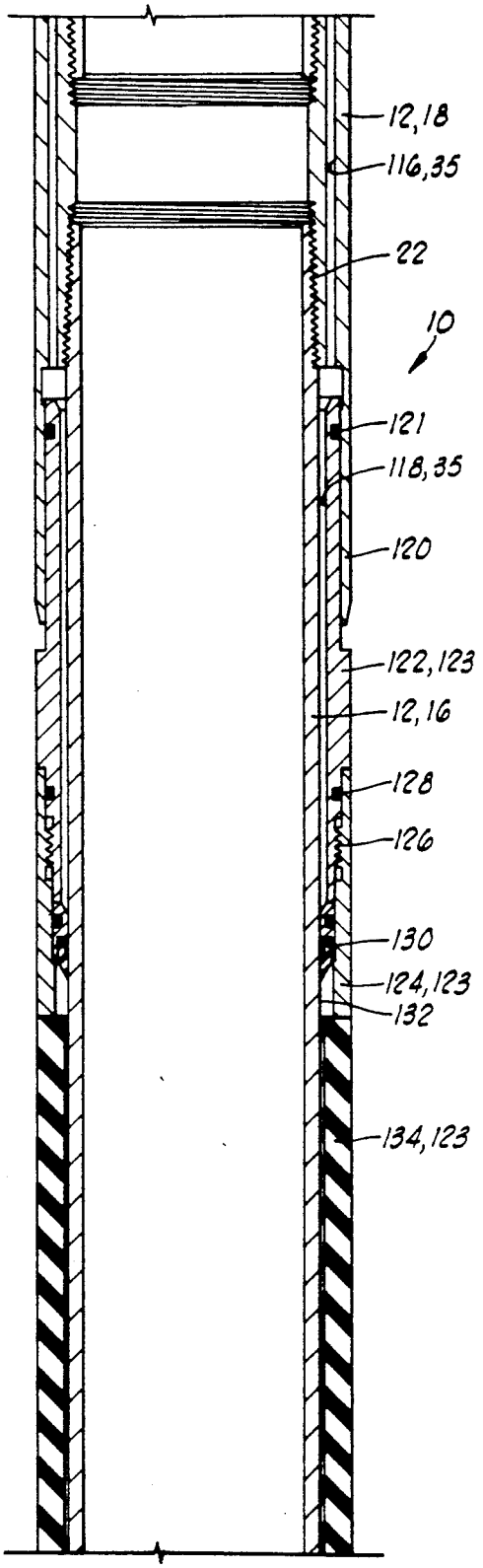
Figure 1C:
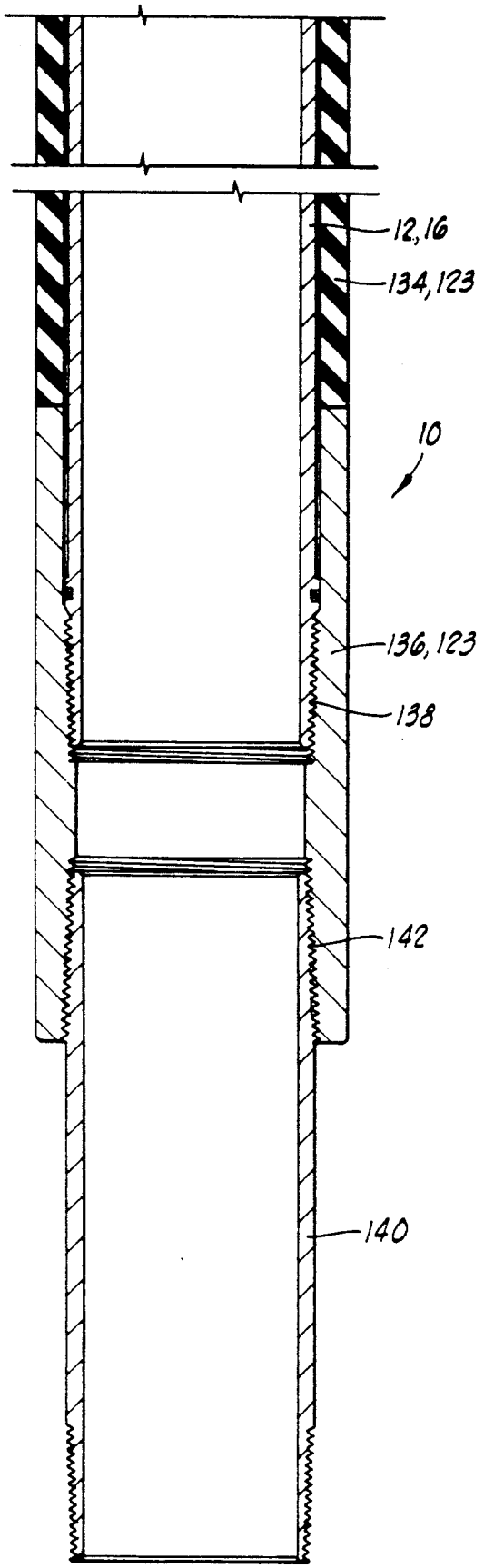

Referring now to the drawings, and more particularly to FIGS. 1A-1C, a first embodiment of the stage cementer and inflation packer apparatus of the present invention is shown and generally designated by the numeral 10. First embodiment 10 includes a substantially tubular mandrel 12, which may also be referred to as a housing 12, comprising an upper mandrel 14 and a lower mandrel 16. Mandrel 12 also comprises a connecting means for interconnecting upper mandrel 14 and lower mandrel 16. In the illustrated embodiment, this connecting means is characterized by a mandrel coupling 18 attached to upper mandrel 14 by threaded connection 20 and to lower mandrel 16 by threaded connection 22.

Upper mandrel 14 has an internally threaded surface 24 at the upper end thereof adapted for connection to a casing string. Mandrel 12 defines an inner passage 26 therein, at least partially defined by bore 28 in upper mandrel 14.

Upper mandrel 14 of mandrel 12 has a first outer surface 30 and a slightly smaller second outer surface 32 below the first outer surface. At least one transversely disposed mandrel port 34 is defined through the wall of upper mandrel 14 and extends between bore 28 and first outer surface 30. As will be further described herein, mandrel port 34 is used as an inflation port forming part of an inflation passage means 35 and as a cementing port. As will be further described herein, inflation passageway means 35 provides communication between the inner passage 26 in mandrel 12 and inflatable packing means 123 connected to the mandrel.

Also defined in upper mandrel 14 are a plurality of longitudinally extending slots 36. Slots 36 are preferably disposed above mandrel port 34.

First embodiment 10 includes an outer, external closure sleeve 38 having a bore 39 which is concentrically, closely, slidably received about first outer surface 30 of upper mandrel 14 of mandrel 12. Closure sleeve 38 is movable relative to mandrel 12 between an open position, as seen in FIG. 1A, and a closed position wherein mandrel port 34 is covered and closed by closure sleeve 38, as will be further described herein.

A support ring 41 is threadingly engaged with mandrel 12 above closure sleeve 38 and acts as an upper stop for the closure sleeve.

A sealing means, such as an upper seal 40 and a lower seal 42, provides sealing engagement between closure sleeve 38 and outer surface 30 of upper mandrel 14. Upper seal 40 is always disposed above slots 36. In the open position shown in FIG. 1A lower seal 42 is disposed between slots 36 and mandrel port 34.

Closure sleeve 38 has a first outer surface 44 and a smaller second outer surface 46 below the first outer surface. At least a portion of second outer surface 46 is slidably received within first bore 48 defined in an upper portion 50 of mandrel coupling 18. Thus, upper portion 50 of mandrel coupling 18 acts as a housing for slidably receiving the lower end of closure sleeve 38.

A sealing means, such as an O-ring 52, provides sealing engagement between closure sleeve 38 and upper portion 50 of mandrel coupling 18.

A lock ring 53 is carried by the lower end of closure sleeve 38 below O-ring 52. Lock ring 53 is adapted for lockingly engaging an undercut 55 at the lower end of first bore 48 so that, when closure sleeve 38 is moved to its closed position, lock ring 53 will lock the closure sleeve in this position.

A groove 54 and annular recess 56 are defined in closure sleeve 38. Recess 56 generally faces a portion of both first outside diameter 30 and second outside diameter 32 of upper mandrel 14. An annulus 58 is thus defined between closure sleeve 38 and upper mandrel 14 and is in communication with mandrel port 34. Annulus 58 forms a portion of inflation passage means 35. A plurality of longitudinal slots 60 insure communication between annulus 58 and another annulus 62 which is defined between upper mandrel 14 and upper portion 50 of mandrel coupling 18. Longitudinal slot 60 and annulus 62 also form portions of inflation passage means 35.

Closure sleeve 38 also defines a transversely disposed first threaded sleeve port 66 and a second threaded sleeve port 68. First threaded sleeve port 66 is preferably aligned with mandrel port 34, and as will be further described herein acts as a pressure relief and cementing port. First and second sleeve ports 66 and 68 will be see to be in communication with annulus 58. A pressure relief means 70 is threadingly engaged with first sleeve port 66, and a pressure equalizing means 72 is threadingly engaged with second sleeve port 68.

Figure 7:
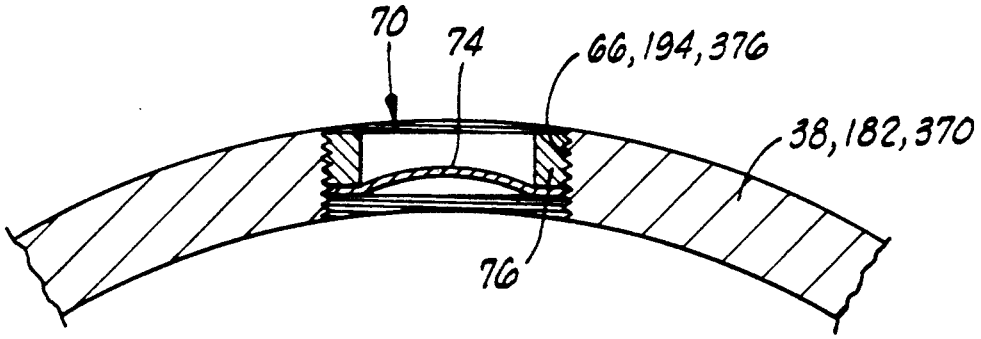
FIG. 7 is a partial cross section taken along lines 7—7 in FIG. 1A, FIG. 2A, FIG. 3A, FIG. 4A, FIG. 5A, or FIG. 6A.

Referring now to FIG. 7, a preferred embodiment of pressure relief means 70 is illustrated as a rupture means characterized by a rupture disc 74 which is attached to a rupture disc retainer 76 by means such as braising or welding. Rupture disc retainer 76 is threaded into first sleeve port 66.

Figure 8:
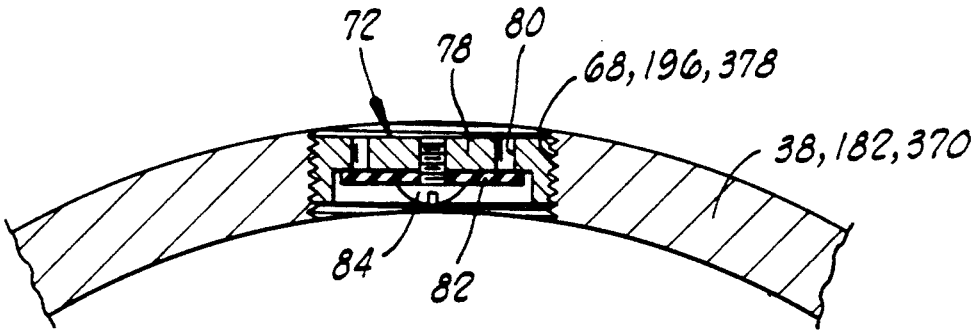
FIG. 8 is a partial cross section taken along lines 8—8 FIG. 1A, FIG. 2A, FIG. 3A, FIG. 4A, FIG. 5A, or FIG. 6A.

Referring now to FIG. 8, pressure equalizing means 72 is characterized by a back check valve assembly 72. Back check valve assembly 72 includes a valve seat 78 which has a plurality of openings 80 therethrough and is threadingly engaged with second sleeve port 68. A flexible valve member 82 is attached to the inside of valve seat 78 by a fastening means, such as screw 84. It will be seen by those skilled in the art that due to the flexibility of valve member 82, fluid may flow inwardly through valve equalizing means 72 but outward flow is prevented. This prevents an undesired pressure differential across rupture disc 74 in pressure relief means 70 as the tool is run into the well bore. That is, pressure equalizing means 72 insures that the pressure on both sides of rupture disc 74 is equalized and rupture disc 74 will not be ruptured inwardly by pressure from the well bore.

Referring again to FIG. 1A, first embodiment 10 includes an inner operating sleeve 84 which is slidably received in bore 28 of upper mandrel 14 of mandrel 12. Operating sleeve 84 is slidable between a first position relative to mandrel 12, as seen in FIG. 1A, and a second position corresponding to the closed position of closure sleeve 38, as will be further described herein.

A plurality of shear pins 86 initially hold operating sleeve 84 in its first position. A sealing means, such as O-ring 88, provides sealing engagement between operating sleeve 84 and upper mandrel 14.

A plurality of pins, such as the two pins 90 shown in FIG. 1A, extend through slots 36 in upper mandrel 14 and are fixably connected to operating sleeve 84 and closure sleeve 38 for common longitudinal movement relative to mandrel 12 throughout the entire movement of operating sleeve 84 from its first position to its second position. Since pins 9 fixedly connect operating sleeve 84 to closure sleeve 38, there is no lost longitudinal motion of operating sleeve 84 relative to closure sleeve 38 as the operating sleeve moves downwardly to close mandrel port 34 with closure sleeve 38.

Each pin 90 is threadingly engaged with a threaded opening 92 in operating sleeve 84 and extend through slot 36 in upper mandrel 14 to tightly engage groove 54 in closure sleeve 38.

Pins 90 in their engagement with operating sleeve 84 and closure sleeve 38 may all be referred to as an interlocking means, and more particularly a mechanical interlocking means, extending through slots 36 and operably associated with both the operating sleeve and the closure sleeve for transferring a closing force from the operating sleeve to the closure sleeve, and thereby moving closure sleeve 38 to its closed position as operating sleeve 84 moves from its first position to its second position.

Pins 90 also serve to hold operating sleeve 84 so that it will not rotate as operating sleeve 84 is later drilled out of mandrel 12 after the cementing job is completed.

First embodiment 10 further includes an internal lower opening sleeve 94 slidably received in bore 28 of upper mandrel 14 below operating sleeve 84. Opening sleeve 94 is slidable between a closed position as shown in FIG. 1A covering mandrel port 34 and an open position wherein mandrel port 34 is uncovered by opening sleeve 94 as the opening sleeve moves downwardly relative to mandrel 12. It is noted that when opening sleeve 94 is in its closed position as shown in FIG. 1A, operating sleeve 84 is simultaneously in its first position, and inner passage 26 of upper mandrel 14 of mandrel 12 is in fluid pressure communication with bore 39 of closure sleeve 38 between seals 40 and 42. This is because there is no seal between the lower end of opening sleeve 84 and upper mandrel 14.

Opening sleeve 94 in the embodiment of FIG. 1A is a plug operated sleeve having an annular seat 96 defined on its upper end which is constructed for engagement with a pump-down or free-fall plug (not shown) of a kind known in the art. A plurality of shear pins 98 initially hold opening sleeve 9 in its closed position. A sealing means, such as upper and lower O-rings 100 and 102, provides sealing engagement between opening sleeve 94 and bore 28 of upper mandrel 14 above and below mandrel port 34, respectively, when the opening sleeve is in its closed position.

An anchor ring 104 is disposed in bore 28 of upper mandrel 14 and is spaced below opening sleeve 94 when the opening sleeve is in its closed position. Anchor ring 104 is locked in position by a retainer ring 106. A sealing means, such as O-ring 108, provides sealing engagement between anchor ring 104 and upper mandrel 14.

When opening sleeve 94 is moved to its open position, as further described herein, it moves downwardly until it abuts anchor ring 104. A lower end 109 of opening sleeve 94 acts as a lug which is received within an upwardly facing recess 110 on anchor ring 104 when the opening sleeve is moved to its closed position. This prevents opening sleeve 94 from rotating relative to anchor ring 104 in mandrel 12 at a later time when the internal components are drilled out of mandrel 12. Similarly, a lug 112 on the upper end of opening sleeve 94 is received within a downwardly facing recess 114 on the lower end of operating sleeve 84 when the opening sleeve is in its open position and the operating sleeve is moved to its second position. This prevents operating sleeve 84 from rotating relative to opening sleeve 94 in mandrel 12 at a later time when the internal components are drilled out of the mandrel.

Referring now also to FIG. IB, at least one longitudinally disposed passageway 116 is disposed through mandrel coupling 18 and provides communication between annulus 62 and a lower annulus 118. Passageway 116 and lower annulus 118 form portions of inflation passage means 35. A lower portion 120 of mandrel coupling 18 has the upper end of a check valve retainer 122 disposed therein, and it will be seen that at least a portion of annulus 118 is defined between check valve retainer 122 and lower mandrel 16 of mandrel 12. A sealing means, such as O-ring 121, provides sealing engagement between check valve retainer 122 and lower portion 120 of mandrel coupling 18.

Check valve retainer 122 is a portion of an inflatable packing means 123 which is connected to mandrel 12. More particularly, inflatable packing means 123 is substantially disposed about lower mandrel 16. Inflatable packing means 123 also includes an upper packer shoe 124 which is attached to check valve retainer 122 at threaded connection 126. A sealing means, such as O-ring 128, provides sealing engagement therebetween.

A check valve 130 is disposed adjacent to the lower end of check valve retainer 122 and sealingly engages outer surface 132 of lower mandrel 16. Check valve 130 is of a kind known in the art and allows fluid flow downwardly while preventing upward fluid flow.

Inflatable packing means 123 also comprises an elastomeric packer element 134 which is disposed around lower mandrel 16 and attached to upper packer shoe 124.

Referring now to 1C, inflatable packing means 123 further includes a lower packer shoe 136 which is connected to the lower end of packer element 134. The lower end of lower mandrel 16 of mandrel 12 is connected to lower packer shoe 136 at threaded connection 138. Preferably, lower packer shoe 136 is fixedly attached to lower mandrel 16, such as by welding. Thus, lower packer shoe 136 is integral with lower mandrel 16 and may be considered a portion thereof.

A lower nipple 140 is connected to lower packer shoe 136 at threaded connection 142. The lower end of lower nipple 140 is adapted for connection to lower casing string components.

Second Embodiment

Figure 2A:
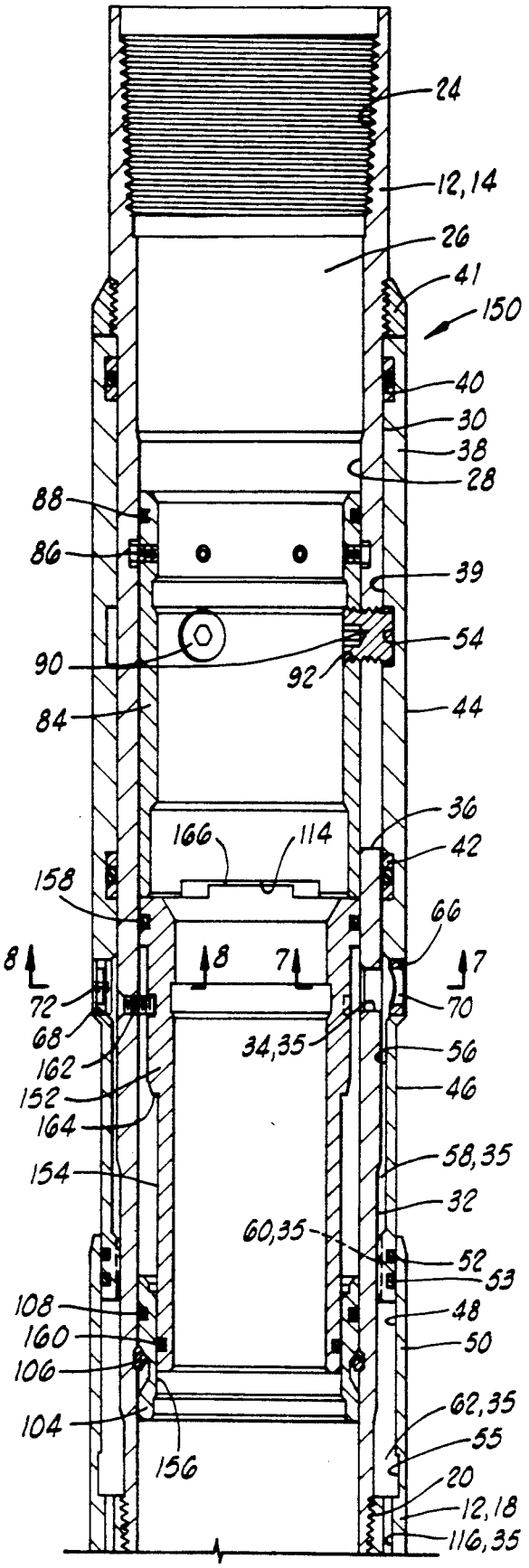
FIGS. 2A-2C show a cross section of the second preferred embodiment of the invention utilizing a hydraulically operated lower internal opening sleeve.
Figure 2B:
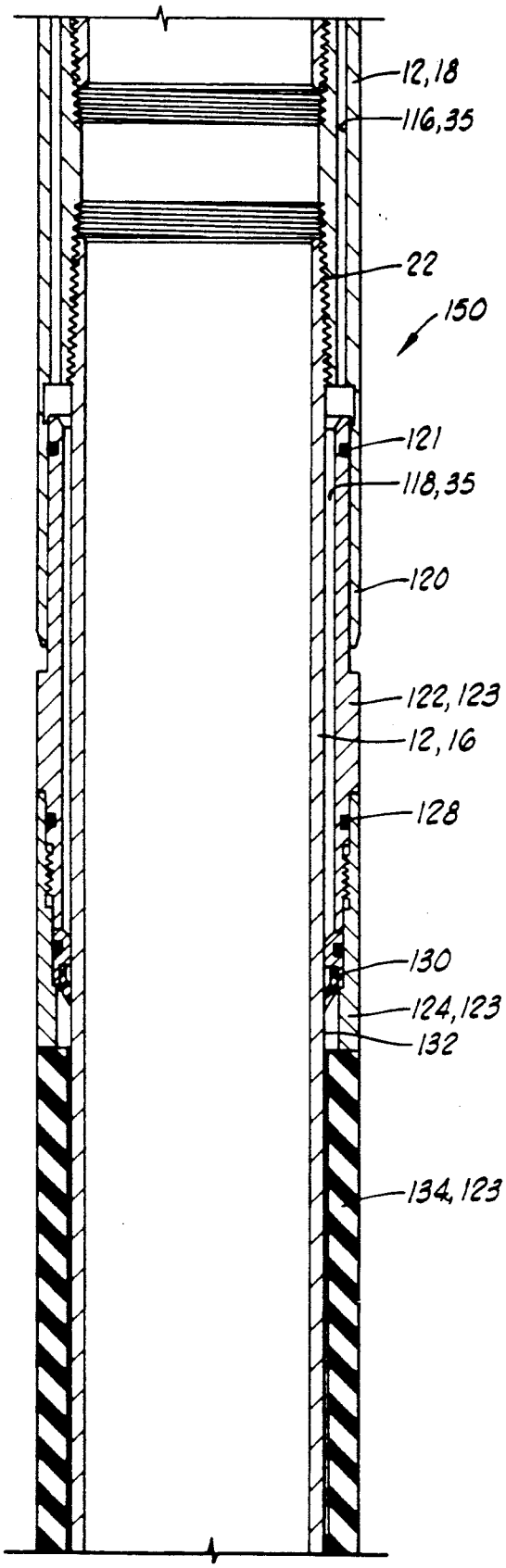
Figure 2C:
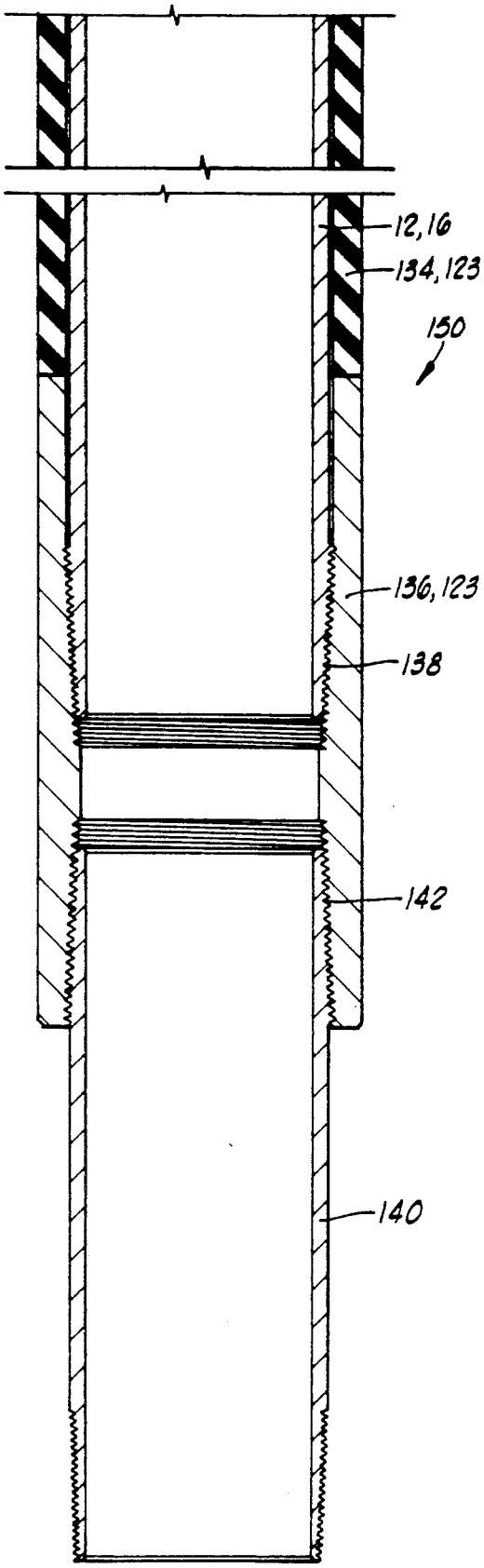

Referring now to FIGS. 2A–2C, a second embodiment of the stage cementer and inflation packer apparatus of the present invention is shown and generally designated by the numeral 150. Second embodiment 150 is virtually the same as first embodiment 10 except for the opening sleeve.

Second embodiment 150 includes a hydraulically operated opening sleeve 152 which has a reduced diameter lower portion 154 which is slidably received within a bore 156 of anchor ring 104. An upper sliding sealing means, such as O-ring 158, provides sealing engagement between opening sleeve 152 and bore 28 in upper mandrel 14 of mandrel 12, and a lower sliding sealing means, such as O-ring 160, provides sealing engagement between operating sleeve 152 and bore 156 in anchor ring 104. It will be seen by those skilled in the art that when opening sleeve 152 is in its initial, closed position, it covers and sealingly closes mandrel port 34 in upper mandrel 14 due to the action of seals 158 and 160 and O-ring 108 which seals between anchor ring 104 and bore 28 in upper mandrel 14.

Opening sleeve 152 is initially held in this closed position by a plurality of shear pins 162.

As is further described herein, a high predetermined pressure can be applied to inner passage 26 through mandrel 12, and this pressure will act downwardly on the differential area between O-rings 158 and 160 until the force exceeds that which can be held by shear pins 162. Shear pins 162 will then shear, and the downwardly acting differential pressure will move opening sleeve 152 downwardly until a shoulder 164 thereon engages anchor ring 104.

However, if the predetermined pressure is not attainable, opening sleeve 152 may be opened using a pump-down or free-fall plug to move the opening sleeve to its open position in a manner substantially identical to opening sleeve 94 in first embodiment 10.

Opening sleeve 152 has an upwardly extending lug 166 which will be received by downwardly facing recess 114 in operating sleeve 84 when opening sleeve 152 is in its open position and operating sleeve 84 is moved to its second position. Non-rotating engagement is provided between shoulder 164 of opening sleeve 152 and the upper end of anchor ring 104 by a similar lug and recess type interlocking structure (not shown). This interlocking prevents operating sleeve 84 from rotating relative to opening sleeve 152 and prevents opening sleeve 152 from rotating relative to anchor ring 104 and mandrel 12 at a later time when the internal components are drilled out of mandrel 12.

Operation of the First and Second Embodiments

Either first embodiment 10 or second embodiment 150 of the stage cementer and inflation packer is made up as part of the casing string which is run into the well bore in a manner known in the art. Depending upon the embodiment, the apparatus is in the configuration shown in FIGS. 1A–1C or FIGS. 2A–2C when run into the well bore.

As apparatus 10 or 150 is run into the hole, the pressure in the well annulus and the pressure in annulus 58 in the tool is equalized through pressure equalizing means 72. Fluid in the well bore will pass through openings 80 in valve body 78 and deflect valve member 82 inwardly (see FIG. 8). This prevents premature rupturing of rupture disc 74 (see FIG. 7).

Cementing of the first or bottom stage below apparatus 10 or 150 is carried out in a manner known in the art. This places cement between the casing and the well bore at a location below apparatus 10 or 150.

After the first stage cementing operation is completed, the opening sleeve is actuated. In the first embodiment of FIGS 1A–1C, this is accomplished by dropping into the casing a pump-down or free-fall opening plug (not shown) of a kind known in the art. The opening plug engages annular seat 96 in opening sleeve 94.

Pressure is then applied to the casing which forces the opening plug against opening sleeve 94, thereby shearing shear pins 98 and moving opening sleeve 94 downwardly from its closed position until lower end 108 thereof contacts anchor ring 104. This places opening sleeve 94 in its open position, and it will be seen by those skilled in the art, that mandrel port 34 is thus opened and placed in communication with inner passage 26 in mandrel 12.

In second embodiment 150, a pump-down or free-fall plug is not required. Rather, pressure is increased within the casing string and thus within the second embodiment apparatus 150 which acts against the differential area defined on opening sleeve 152 between O-rings 158 and 160 until shear pins 162 are sheared and opening sleeve 152 is moved downwardly until shoulder 164 thereof contacts anchor ring 104. This places opening sleeve 152 in its open position, and it will be seen by those skilled in the art, that, as with first embodiment 10, mandrel port 34 is thus opened and placed in communication with inner passage 26 of mandrel 12. As previously mentioned, a plug may be used to open opening sleeve 152 if the pressure is not sufficiently high.

Thereafter, operation of first embodiment 10 and second embodiment 150 is identical.

As casing pressure is increased, fluid passes through inflation passage means 35 to inflatable packing means 123. That is, fluid passes from inner passage 26 through mandrel port 34 into annulus 58, then through longitudinal passageway 116 and lower annulus 118 to check valve 130. The fluid flows past check valve 130 into inflatable packing means 123. Check valve 130 insures that there is no back flow out of inflatable packing means 123. As packer element 134 inflates, check valve retainer 122 which is attached to upper packer shoe 124 slides downwardly within lower portion 120 of mandrel coupling 18, allowing packer element 134 to be brought into sealing engagement with the well bore.

When pressure in the casing, and thus in inner passage 26 and inflation passage means 35, reaches a predetermined level, rupture disc 74 of pressure relief means 70 will rupture outwardly. It will be seen that this places first sleeve port 66 in closure sleeve 38 and mandrel port 34 in communication with the well annulus. Then cement for the second stage cementing can be pumped down the casing with the displacing fluids located therebelow being circulated through aligned ports 34 and 66 and back u the well annulus. A bottom cementing plug (not shown) may be run below the cement, and a top cementing plug (not shown) is run at the upper extremity of the cement, in a manner known in the art.

The bottom plug, if any, will seat against operating sleeve 84, and further pressure applied to the cement column will rupture a rupture disc in the bottom cementing plug. The cement will then flow through the bottom cementing plug and through aligned ports 34 and 66 and upwardly through the well annulus.

When the top cementing plug seats against the bottom cementing plug, the second stage of cementing is terminated. Further pressure applied to the casing forces the top and bottom cementing plugs against operating sleeve 84, forcing it downwardly from its first position to its second position. Because of the mechanical interlocking by pins 90 between operating sleeve 84 and closure sleeve 38, closure sleeve 38 is moved downwardly from its open to closed position as operating sleeve 84 is moved downwardly from its first to its second position. As this occurs, lower seal 42 in closure sleeve 38 is moved below mandrel port 34, thus sealingly separating mandrel port 34 from first sleeve port 66. The interaction between lock ring 53 and undercut 55 locks closure sleeve 38 in the close position.

It will be seen by those skilled in the art that fluid may then no longer flow through mandrel port 34 and out first sleeve port 66 into the well annulus. Second outer surface 46 on closure sleeve 38 slides downwardly within upper portion 50 of mandrel coupling 18. Downward movement of operating sleeve 84 and closure sleeve 38 stops when the lower end of operating sleeve 84 engages the top of opening sleeve 94 in first embodiment 10 or opening sleeve 152 in second embodiment 150.

Subsequent to this cementing operation, the upper and lower cementing plugs, operating sleeve 84, opening sleeve 94 or 152, and anchor ring 104 can all be drilled out of mandrel 12 leaving a smooth bore through the apparatus. The components to be drilled out may be made of easily drillable material such as aluminum. Since all of the components are non-rotatably locked to each other and to mandrel 12, as previously described, the drilling out of the components is further aided.

Third Embodiment

Figure 3A:
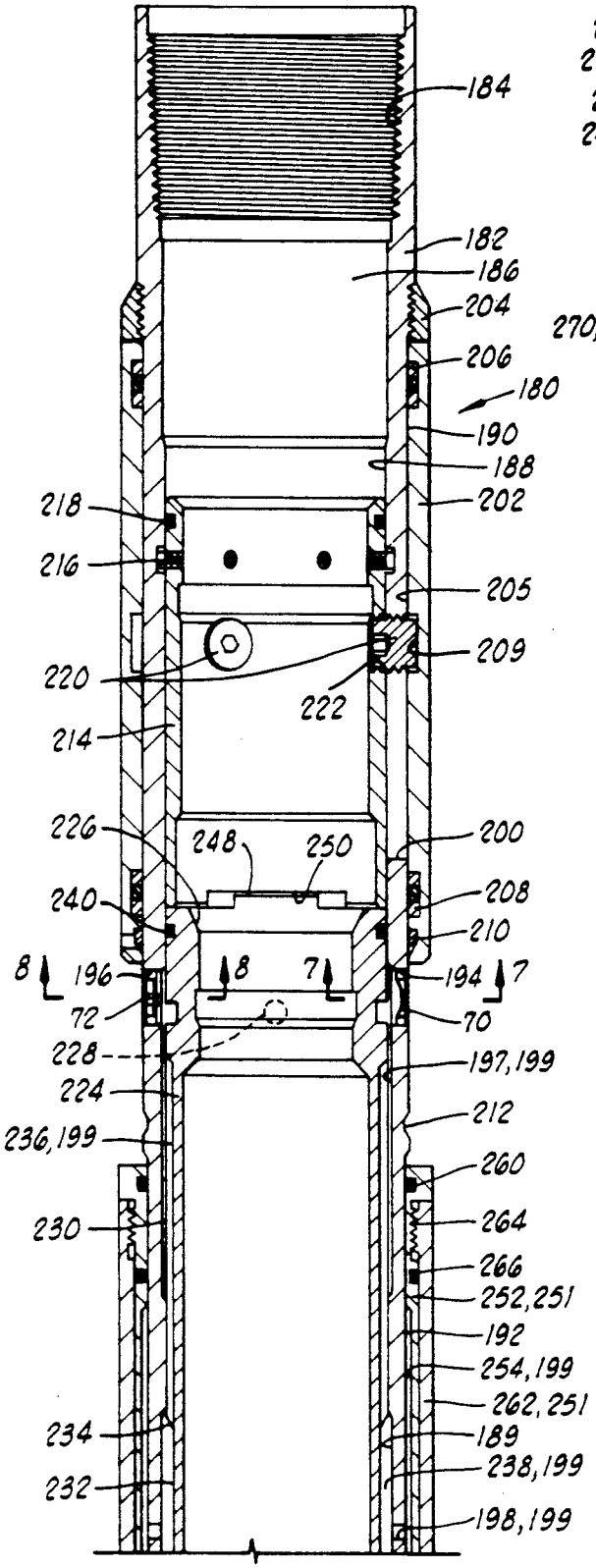
FIGS. 3A and 3B illustrate a third embodiment which utilizes a plug actuated lower internal opening sleeve.
Figure 3B:
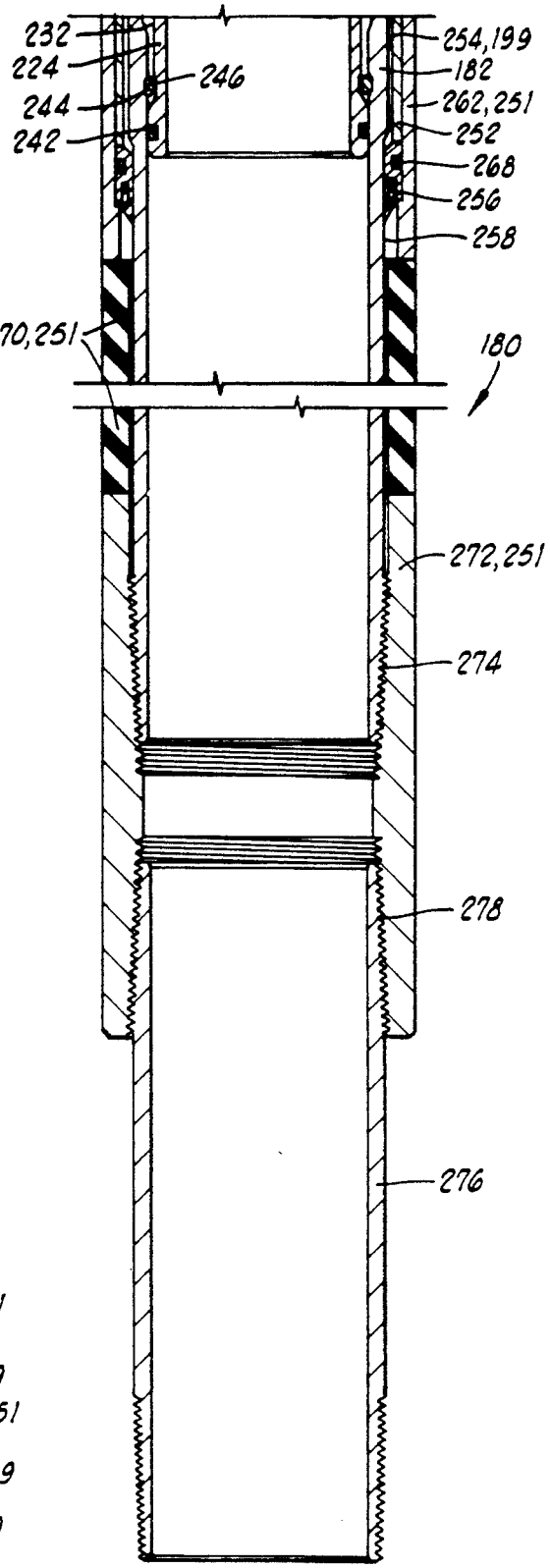

Referring now to FIGS. 3A and 3B, a third embodiment of the stage cementer and inflation packer apparatus of the present invention is shown and generally designated by the numeral 180. Third embodiment 180 includes a substantially tubular mandrel 182, which may also be referred to as a housing 182.

Mandrel 182 has an internally threaded surface 184 at the upper end thereof adapted for connection to a casing string. Mandrel 182 defines an inner passage 186 therein, at least partially defined by first bore 188 in the mandrel. Below first bore 188 is a second bore 189 forming a recess in mandrel 182.

Mandrel 182 has a first outer surface 190 and a slightly smaller second outer surface 192 below the first outer surface.

Mandrel 182 defines a transversely disposed first threaded mandrel port 194 and a second threaded mandrel port 196. As will be further described herein, first threaded mandrel port 194 acts as a cementing port 194. First and second mandrel ports 194 and 196 extend between first bore 188 and first outer surface 190 of mandrel 182. A pressure relief means 70 is threadingly engaged with first mandrel port 194, and a pressure equalizing means 72 is threadingly engaged with second mandrel port 196. Pressure relief means 70 and pressure equalizing means 72 are the same as in first embodiment 10 and second embodiment 150 of the apparatus. Referring again to FIGS. 7 and 8, details of pressure relief means 70 and pressure equalizing means 72 are shown, as previously described.

Mandrel 182 also defines an annular recess 197 and at least one transversely disposed third mandrel port 198 through a wall thereof which extends between second bore 189 and second outer surface 192. Third mandrel port 198 is used as an inflation port and is in communication with recess 197. Recess 197 and third mandrel port 198 form parts of an inflation passage means 199 for providing communication between inner passage 186 and an inflatable packing means 251 as further described herein.

Also defined in mandrel 182 are a plurality of longitudinally extending slots 200. Slots 200 are preferably disposed above first and second mandrel ports 194 and 196.

Third embodiment 180 includes an outer, external closure sleeve 202 having a bore 205 which is concentrically, closely, slidably received about first outer surface 190 of mandrel 182. Closure sleeve 202 is movable relative to mandrel 182 between an open position, as seen in FIG. 3A, in which the closure sleeve is disposed above first and second mandrel ports 194 and 196, and a closed position wherein mandrel ports 194 and 196 are covered and closed by closure sleeve 202, as will be further described herein.

A support ring 204 is threadingly engaged with mandrel 182 above closure sleeve 202 and acts as an upper stop for the closure sleeve.

A sealing means, such as upper seal 206 and lower seal 208, provides sealing engagement between closure sleeve 202 and outer surface 190 of mandrel 182. Upper seal 206 is always disposed above slots 200. In the open position shown in FIG. 3A, lower seal 208 is disposed between slots 200 and first and second mandrel ports 194 and 196. Closure sleeve 202 also defines a groove 209 therein which is located between upper seal 206 and lower seal 208.

A retainer ring 210 is carried by the lower end of closure sleeve 202 below lower seal 208. Retainer ring 210 is adapted for locking engagement with a retainer ring groove 212 defined in outer surface 190 of mandrel 182 at a position below first and second mandrel ports 194 and 196. When closure sleeve 202 is moved from its open position to its closed position, retainer ring 210 will lock the closure sleeve in the closed position.

Third embodiment 180 includes an inner operating sleeve 214 which is slidably received in bore 188 of mandrel 182. Operating sleeve 214 may be substantially identical to operating sleeve 84 in first embodiment 10 and second embodiment 150 and is slidable between a first position relative to mandrel 182, as seen in FIG. 3A, and a second position corresponding to the closed position of closure sleeve 202, as will be further described herein.

A plurality of shear pins 216 initially hold operating sleeve 214 in its first position. A sealing means, such as O-ring 218, provides sealing engagement between operating sleeve 214 and mandrel 182.

A plurality of pins, such as the two pins 220 shown in FIG. 3A, extend through slots 200 in mandrel 182 and are fixably connected to operating sleeve 214 and closure sleeve 202 for common longitudinal movement relative to mandrel 182 throughout the entire movement of operating sleeve 214 from its first position to its closed position. Since pins 220 fixedly connect operating sleeve 214 with closure sleeve 202, there is no lost longitudinal motion of operating sleeve 214 relative to closure sleeve 202 as the operating sleeve moves downwardly to close mandrel ports 194 and 196 with closure sleeve 202.

Each pin 220 may be substantially identical to pin 90 in first embodiment 10 and second embodiment 150 and is threadingly engaged with a threaded opening 222 in operating sleeve 214 and extend through slot 200 in mandrel 182 to tightly engage groove 209 in closure sleeve 202.

Pins 220 in their engagement with operating sleeve 214 and closure sleeve 202 may all be referred to as an interlocking means, and more particularly a mechanical interlocking means, extending through slots 200 and are operably associated with both the operating sleeve and the closure sleeve for transferring a closing force from the operating sleeve to the closure sleeve and thereby moving closure sleeve 202 to its closed position as operating sleeve 214 moves from its first position to its second position.

Pins 220 also serve to hold operating sleeve 214 so that it will not rotate as operating sleeve 214 is later drilled out of mandrel 182 after the cementing job is completed.

Third embodiment 180 further includes an internal lower opening sleeve 224 slidably received in bore 188 of mandrel 182 below operating sleeve 214. Opening sleeve 224 is slidable between a closed position as shown in FIG. 3A covering mandrel ports 194 and 196 and an open position wherein mandrel ports 194 and 196 are uncovered by opening sleeve 224 as the opening sleeve moves downwardly relative to mandrel 182. It is noted that when opening sleeve 224 is in its closed position as shown in FIG. 3A, operating sleeve 214 is simultaneously in its first position, and inner passage 186 of mandrel 182 is in fluid pressure communication with bore 205 of closure sleeve 202 between seals 206 and 208. This is because there is no seal between the lower end of opening sleeve 214 and mandrel 182.

Opening sleeve 224 in the embodiment of FIG. 3A is a plug-operated sleeve having an annular seat 226 on its upper end which is constructed for engagement with a pump-down or free-fall plug (not shown) of a kind known in the art. A plurality of shear pins 228 initially hold opening sleeve 224 in its closed position.

Opening sleeve 224 has a first outer surface 230 which is concentrically, closely, slidably received within bore 188 in mandrel 182. Operating sleeve 224 also has a smaller second outer surface 232 below first outer surface 230, and a chamfered shoulder 234 extends between first outer surface 230 and second outer surface 232.

A plurality of longitudinal slots 236 ar formed in first outer surface 230 of operating sleeve 224. Slots 236 form a part of inflation passage means 199 and are in communication with recess 197 in mandrel 182. Slots 236 extend downwardly through shoulder 234 so that slots 236 are also in communication with an annulus 238 defined between second bore 189 in mandrel 182 and operating sleeve 224. Annulus 238 also forms a part of inflation passage means 199. Thus, it will be seen that first and second mandrel ports 194 and 196 are in communication with each other and further in communication with third mandrel ports 198.

Referring now to FIGS. 3A and 3B, a sealing means, such as upper and lower O-rings 240 and 242, provide sealing engagement between opening sleeve 224 and mandrel 182, above first and second mandrel ports 194 and 196 and below third mandrel ports 198, respectively, when the opening sleeve is in its closed position.

A retainer ring 244 is engaged with a retainer ring groove 246 in mandrel 182. Second outer surface 232 of operating mandrel 214 is sized such that it will slide within retainer ring 244 as the operating sleeve is moved downwardly. When operating sleeve 224 is moved to its open position, as further described herein, it moves downwardly until shoulder 234 thereon abuts retainer ring 244, locking the operating sleeve with respect to mandrel 182. This locking action prevents operating sleeve 224 fiom rotating relative to mandrel 182 at a later time when the internal components are drilled out of the mandrel.

A lug 248 on the upper end of opening sleeve 224 is received within a downwardly facing recess 250 on the lower end of operating sleeve 214 when the opening sleeve is in its open position and the operating sleeve is moved to its second position. This prevents operating sleeve 214 from moving relative to opening sleeve 224 and mandrel 182 at a later time when the internal components are drilled out of the mandrel.

An inflatable packing means 251 is disposed about mandrel 182 below retainer ring groove 212. At its upper end, inflatable packing means 251 includes a check valve retainer 252 which is disposed around second outer surface 190 of mandrel 182. Check valve retainer 252 is dimensioned such that an annulus 254 is defined therebetween. It will be seen that annulus 254 is in communication with third mandrel port 198.

A check valve 256 is disposed adjacent to the lower end of check valve retainer 252 and sealingly engages third outer surface 258 of mandrel 182. Check valve 256 is of a kind known in the art and allows fluid flow downwardly while preventing upward fluid flow.

A sealing means, such as O-ring 260, provides sealing engagement between check valve retainer 252 and mandrel 182 above third mandrel port 198.

Inflatable packing means 251 includes an upper packer shoe 262 is disposed around check valve retainer 252 and is connected thereto at threaded connection 264. A sealing means, such as an upper O-ring 266, shown in FIG. 3A, and a lower O-ring 268, shown in FIG. 3B, provide sealing engagement between upper packer shoe 262 and check valve retainer 252.

Inflatable packing means 251 also includes an elastomeric packer element 270 which is disposed around the lower portion of mandrel 182 and attached to upper packer shoe 262. Packer element 270 may be substantially identical to first and second embodiment packer element 134.

Still referring to FIG. 3B, the lower end of packer element 270 is connected to a lower packer shoe 272. Lower packer shoe 272 also forms a part of inflatable packing means 251. The lower end of mandrel 182 is connected to lower packer shoe 272 at threaded connection 274. A lower nipple 276 is connected to lower packer shoe 272 at threaded connection 278. The lower end of lower nipple 276 is adapted for connection to lower casing string components. Lower packer shoe 272 and lower nipple 276 may be substantially identical to those components in the first and second embodiments.

Fourth Embodiment

Figure 4A:
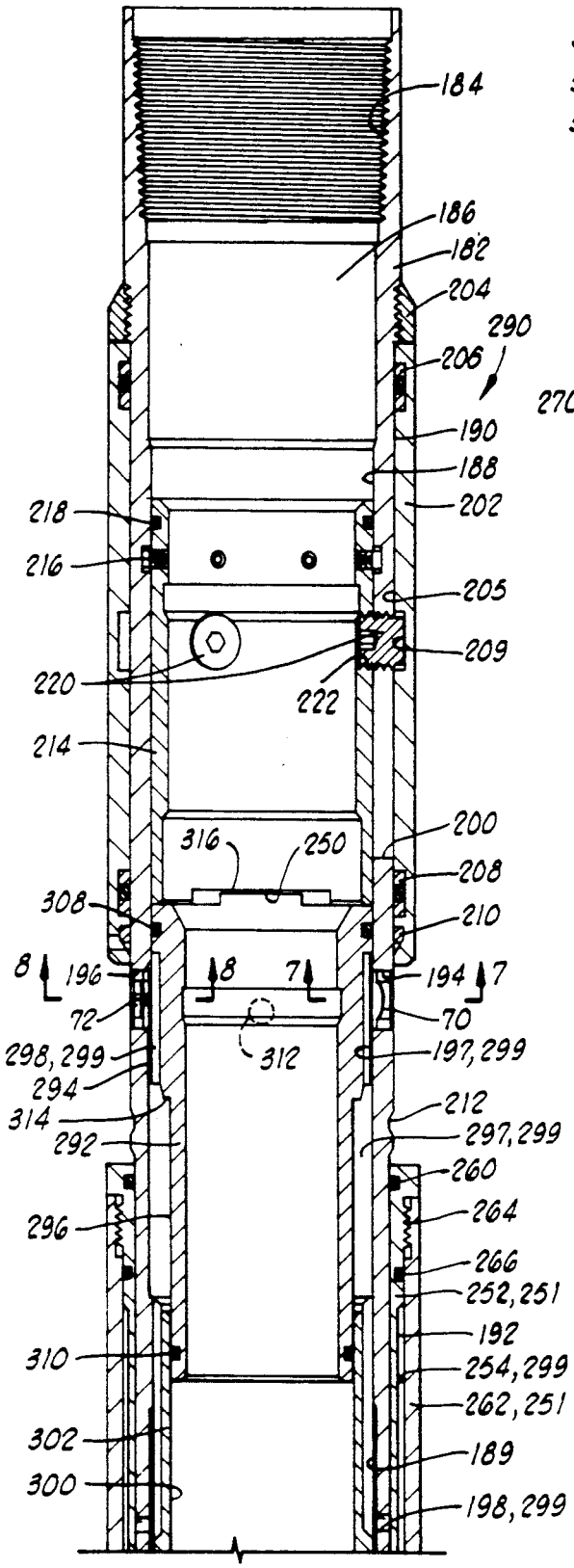
FIGS. 4A and 4B show a fourth embodiment utilizing a hydraulically operated lower internal opening sleeve.
Figure 4B:
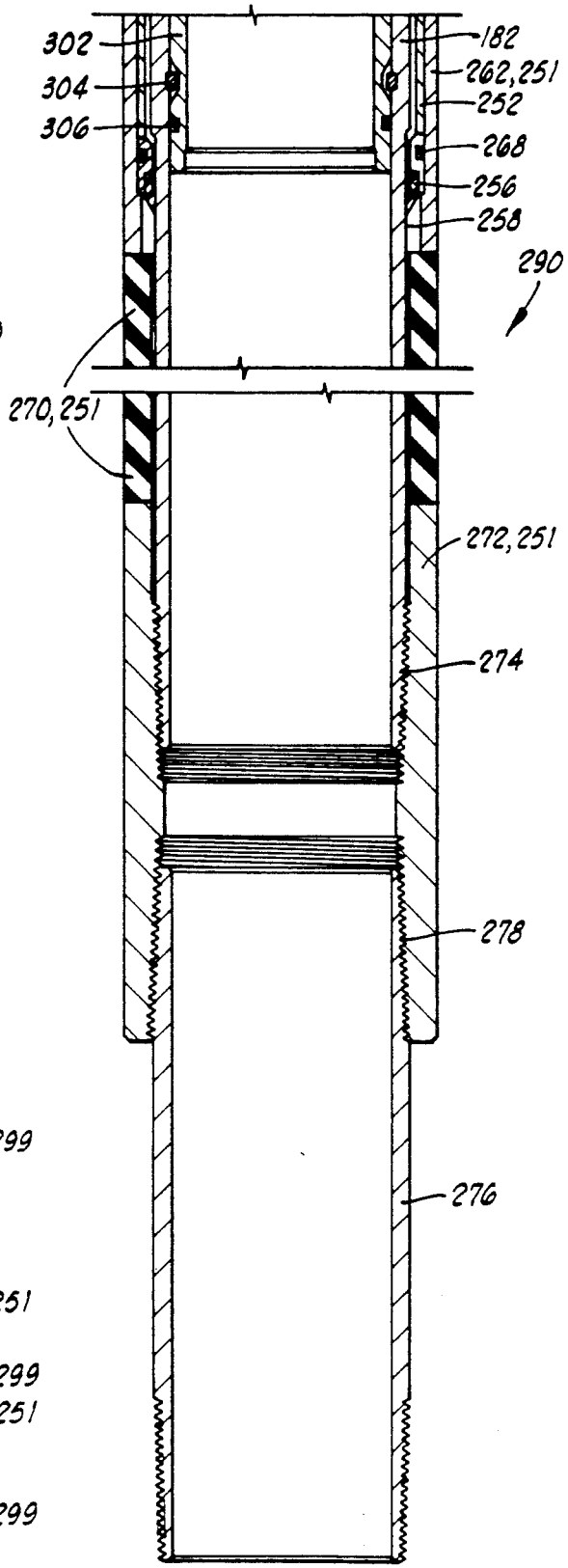

Referring now to FIGS. 4A and 4B, a fourth embodiment of the stage cementer and inflation packer apparatus of the present invention is shown and generally designated by the numeral 290. Fourth embodiment 290 is virtually the same as third embodiment 180 except for the opening sleeve and the addition of an anchor ring 302.

Fourth embodiment 290 includes a hydraulically operated opening sleeve 292 with a first outer surface 294 and a reduced diameter outer surface 296. Thus, an annulus 297 is defined between operating sleeve 292 and mandrel 182. A plurality of slots 298 are defined in first outer surface 294 and are in communication with annulus 297 and with first and second mandrel ports 194 and 196. Slots 298 generally face recess 197 in mandrel 182. Slots 298, recess 197, annulus 297, third mandrel port 198 and annulus 254 form parts of an inflation passage means 299.

Second outer surface 296 of operating sleeve 292 is slidably received within bore 300 of anchor ring 302. Anchor ring 302 is disposed in mandrel 182 and is locked in position by retainer ring 304, as seen in FIG. 4B. A sealing means, such as O-ring 306, provides sealing engagement between anchor ring 302 and mandrel 182.

An upper sliding sealing means, such as O-ring 308, provides sealing engagement between opening sleeve 292 and mandrel 182, and a lower sealing means, such as O-ring 310, provides sealing engagement between operating sleeve 292 and bore 300 in anchor ring 302. It will be seen by those skilled in the art that when opening sleeve 292 is in its initial, closed position, it covers and sealingly closes first and second mandrel ports 194 and 196 in mandrel 182 due to the action of O-rings 308 and 310.

Opening sleeve 292 is initially held in this closed position by a plurality of shear pins 312.

As is further described herein, a high pressure can be applied to inner passage 186 through mandrel 182, and this pressure will act downwardly on the differential area between O-rings 308 and 310 until a force exceeds that Which can be held by shear pins 312. Shear pins 312 will then shear, and the downwardly acting differential pressure will move opening sleeve 292 downwardly until a shoulder 314 thereon engages anchor ring 302.

However, if the predetermined pressure is not attainable, opening sleeve 292 may be opened using a pump-down or free-fall plug to move the opening sleeve to its open position in a manner substantially identical to opening sleeve 224 in third embodiment 180.

Opening sleeve 292 has an upwardly extending lug 316 which will be received by downwardly facing recess 250 in operating sleeve 214 when opening sleeve 292 is in its open position and operating sleeve 214 is moved to its second position. Non-rotating engagement is provided between shoulder 314 of opening sleeve 292 and the upper end of anchor ring 302 by a similar lug and recess type interlocking structure (not shown). This interlocking prevents operating sleeve 214 from rotating relative to opening sleeve 292 and prevents opening sleeve 292 from rotating relative to anchor ring 302 and mandrel 182 at a later time when the internal components are drilled out of mandrel 182.

Operation Of The Third And Fourth Embodiments

Either third embodiment 180 or fourth embodiment 290 of the stage cementer and inflation packer is made up as part of the casing string which is run into the well bore in a manner known in the art. Depending upon the embodiment, the apparatus is in the configuration shown in FIGS. 3A and 3B or FIGS. 4A and 4B when run into the well bore.

As apparatus 180 or 290 is run into the hole, pressure in the well annulus and the pressure in recess 197 of mandrel 182 is equalized through pressure equalizing means 72. Fluid in the well bore will pass through openings 80 in valve body 78 and deflect valve member 82 inwardly (see FIG. 8). This prevents premature rupturing of rupture disc 74 (see FIG. 7).

Cementing of the first or bottom stage below apparatus 180 or 290 is carried out in a manner known in the art. This places cement between the casing and the well bore at a location below apparatus 180 or 290.

After the first stage cementing operation is completed, the opening sleeve is actuated. In the third embodiment of FIGS. 3A and 3B, this is accomplished by dropping into the casing a pump-down or free-fall opening plug (not shown) of a kind known in the art. Opening plug engages annular seat 226 in opening sleeve 224.

Pressure is then applied to the casing which forces the opening plug against opening sleeve 224, thereby shearing shear pins 220 and moving opening sleeve 224 downwardly from its closed position until shoulder 234 thereon contacts retainer ring 244. This places opening sleeve 224 in its open position, and it will be seen by those skilled in the art that first and second mandrel ports 194 and 196 are thus placed in communication with inner passage 186 in mandrel 182.

As casing pressure is increased, fluid passes from inner passage 186 around the upper end of operating sleeve 224, through recess 197, slots 236, annulus 238 and annulus 297 and then through third mandrel ports 298 into annulus 254. Thus, fluid is communicated from inner passage 186 to packer element 270 through inflation passage means 199 of third embodiment 180. The fluid flows past check valve 256 into the packer portion.

In fourth embodiment 290, a pump-down or free-fall plug is not required. Rather, pressure is increased within the casing string and thus within the fourth embodiment apparatus 290 which acts against the differential area defined on opening sleeve 292 between O-rings 308 and 310 until shear pins 312 are sheared and opening sleeve 292 is moved downwardly until shoulder 314 thereof contacts anchor ring 302. This places opening sleeve 292 in its open position, and it will be seen by those skilled in the art, that, as with third embodiment 180, first and second mandrel ports 194 and 196 are thus placed in communication with inner passage 186 of mandrel 182. As previously mentioned, a plug may be used to open opening sleeve 292 if the pressure is not sufficiently high.

As casing pressure is increased in fourth embodiment 290, fluid passes from inner passage 186 around the upper end of opening sleeve 294, through recess 197, slots 298 and annulus 297 and then through third mandrel port 198 into annulus 254. Thus, fluid passes from inner passage 186 to packer element 270 through inflation passage means 299 in fourth embodiment 290. The fluid flows past check valve 256 into the packer portion.

Thereafter, operation of third embodiment 180 and fourth embodiment 290 is identical.

Check valve 256 insures that there is no back flow out of the packer portion. As packer element 270 inflates, check valve retainer 252 and upper packer shoe 262 attached thereto slide downwardly along second outer surface 192 of mandrel 182, allowing packer element 270 to be brought into sealing engagement with the well bore.

When pressure in the casing, and thus in inner passage 186, reaches a predetermined level, rupture disc 74 of pressure relief means 70 will rupture outwardly. It will be seen that this places inner passage 186 in communication with the well annulus. Then cement for the second stage cementing can be pumped down the casing with the displacing fluids located therebelow being circulated through opened first mandrel port 194 and back up the well annulus. A bottom cementing plug (not shown) may be run below the cement, and a top cementing plug (not shown) is run at the upper extremity of the cement, in a manner known in the art.

The bottom plug, if any, will seat against operating sleeve 214, and further pressure applied to the cement column will rupture a rupture disc in the bottom cementing plug. The cement will then flow through the bottom cementing plug and through first mandrel port 194 and upwardly through the well annulus.

When the top cementing plug seats against the bottom cementing plug, the second stage of cementing is terminated. Further pressure applied to the casing forces the top and bottom cementing plugs against operating sleeve 214, forcing it downwardly from its first position to its second position. Because of the mechanical interlocking by pins 220 between operating sleeve 214 and closure sleeve 202, closure sleeve 202 is moved downwardly from its open to closed position as operating sleeve 214 is moved downwardly from its first to its second position. As this occurs, lower seal 208 in closure sleeve 202 is moved below first and second mandrel ports 194 and 196, thus sealingly separating first and second mandrel ports 194 and 196 from the well annulus. It will be seen by those skilled in the art that fluid may then no longer flow through first mandrel port 194 into the well annulus. Downward movement of operating sleeve 214 and closure sleeve 202 stops when retainer ring 210 carried by closure sleeve is aligned with and engages retainer ring groove 212 defined in mandrel 182.

Subsequent to this cementing operation, the upper and lower cementing plugs, operating sleeve 214, opening sleeve 224 or 294, and anchor ring 302 (fourth embodiment 290 only) can all be drilled out of mandrel 182 leaving a smooth bore through the apparatus. The components to be drilled out may be made of easily drillable material such as aluminum. Since all of the components are non-rotatably locked to each other and to mandrel 186, as previously described, the drilling out of the components is further aided.

Fifth Embodiment

Figure 5A:
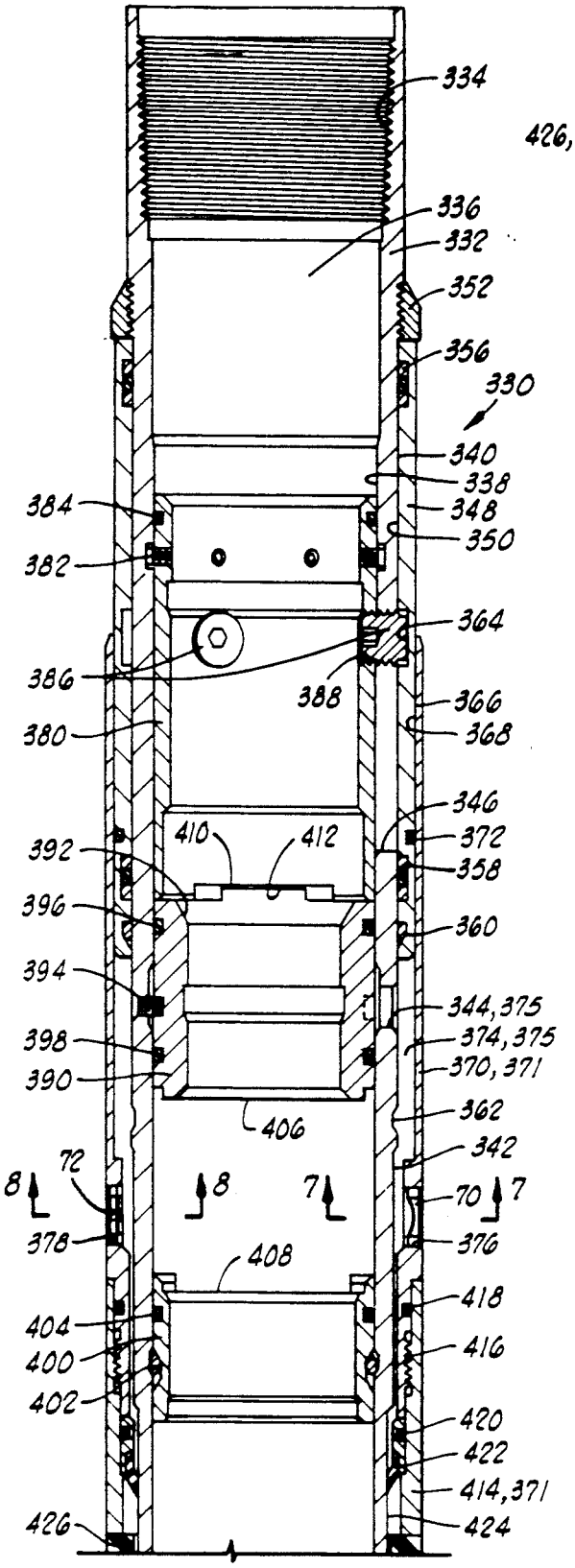
FIGS. 5A and 5B show a cross section of a fifth embodiment utilizing a plug actuated lower internal opening sleeve.
Figure 5B:
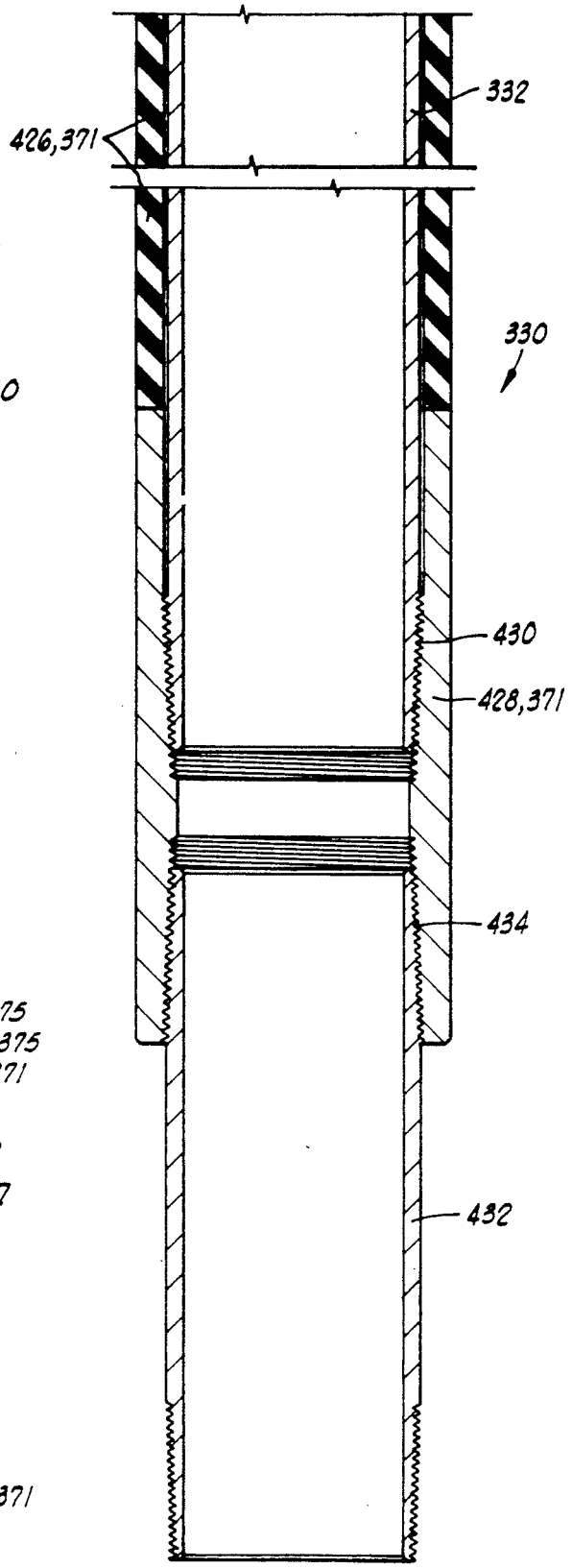

Referring now to FIGS. 5A and 5B, a fifth embodiment of the stage cementer and inflation packer apparatus of the present invention is shown and generally designated by the numeral 330. Fifth embodiment 330 includes a substantially tubular mandrel 332, which may also be referred to as a housing 332.

Mandrel 332 has an internally threaded surface 334 at the upper end thereof adapted for connection to a casing string. Mandrel 332 defines an inner passage 336 therein, at least partially defined by bore 338.

Mandrel 332 has a first outer surface 340 and a slightly smaller second outer surface 342 below the first outer surface. At least one transversely disposed mandrel port 344 is defined through the wall of mandrel 33 and extends between bore 338 and first outer surface 340. As will be further described herein, mandrel port 344 is used as an inflation port and as a cementing port.

Also defined in mandrel 332 are a plurality of longitudinally extending slots 346. Slots 346 are preferably disposed above mandrel port 344.

Fifth embodiment 330 includes an outer, external closure sleeve 348 having a bore 350 therethrough which is concentrically, closely, slidably received about first outer surface 340 of mandrel 332. Closure sleeve 348 is movable relative to mandrel 332 between an open position, as seen in FIG. 5A, and a closed position wherein mandrel port 344 is covered and closed by closure sleeve 348, as will be further described herein.

A support ring 352 is threadingly engaged with mandrel 332 above closure sleeve 348. Support ring 352 provides an upper limit of movement for closure sleeve 348.

A sealing means, such as an upper seal 356 and a lower seal 358, provide sealing engagement between closure sleeve 348 and outer surface 340 of mandrel 332. Upper seal 356 is always disposed above slots 346. In the open position shown in FIG. 5A, lower seal 358 is disposed between slots 346 and mandrel port 344.

A retainer ring 360 is carried by closure sleeve 348 below lower seal 358. Retainer ring 36 is adapted for locking engagement with retainer ring groove 362 defined in first outer surface 340 of mandrel 332 to limit downward movement of closure sleeve 348 as it is moved from the open position shown in FIG. 5A to its closed position.

Closure sleeve 348 further defines a groove 364 therein which is positioned between upper seal 356 and lower seal 358.

Closure sleeve 348 has an outer surface 366 which is slidably received within a bore 368 defined within a check valve retainer 370. Thus, check valve retainer 370 acts as a housing for slidably receiving at least the lower portion of closure sleeve 348. Check valve retainer 370 also forms an upper part of an inflatable packing means 371 disposed around mandrel 332.

A sealing means, such as O-ring 372, provides sealing engagement between closure sleeve 348 and check valve retainer 370.

It will be seen that an annulus 374 is defined between check valve retainer 370 and mandrel 332 below closure sleeve 348. Mandrel port 344 and annulus 374 form an inflation passage means 375, as further described herein.

Check valve retainer 370 defines a transversely disposed first threaded body or housing port 376 and a second threaded body or housing port 378. First and second body ports 376 and 378 will be seen to be in communication with annulus 374. In the embodiment shown, first and second body ports 376 and 378 are disposed longitudinally below mandrel port 344. First body port 376 acts as a cementing port, as will be further described herein.

A pressure relief means 70 is threadingly engaged with first body port 376, and a pressure equalizing means 72 is threadingly engaged with second body port 378. Referring again to FIGS. 7 and 8, pressure relief means 70 and pressure equalizing means 72 are respectively shown and are the same as described for first embodiment 10.

Referring again to FIG. 5A, third embodiment 330 includes an inner operating sleeve 380 which is slidably received in bore 338 of mandrel 332. Operating sleeve 380 is slidable between a first position relative to mandrel 332, as seen in FIG. 5A, and a second position corresponding to the closed position of closure sleeve 348, as will be further described herein. Operating sleeve 380 may be substantially identical to the operating sleeves described above for the other embodiments.

A plurality of shear pins 382 initially hold operating sleeve 380 in its first position. A sealing means, such as O-ring 384, provides sealing engagement between operating sleeve 380 and mandrel 332.

A plurality of pins, such as the two pins 386 shown in FIG. 5A, extend through slots 346 in mandrel 332 and are fixably connected to operating sleeve 380 and closure sleeve 348 for common longitudinal movement relative to mandrel 332 throughout the entire movement of operating sleeve 380 from its first position to its second position. Since pins 386 fixedly connect operating sleeve 380 to closure sleeve 348, there is no lost longitudinal motion of operating sleeve 380 relative to closure sleeve 348 as the operating sleeve moves downwardly to close mandrel port 344 with closure sleeve 348.

Each pin 386 is threadingly engaged with a threaded opening 388 in operating sleeve 380 and extend through slot 346 in mandrel 332 to tightly engage groove 364 in closure sleeve 348.

Pins 386 in their engagement with operating sleeve 380 and closure sleeve 348 may all be referred to as an interlocking means, and more particularly a mechanical interlocking means, extending through slots 346 and are operably associated with both the operating sleeve and the closure sleeve for transferring a closing force from the operating sleeve to the closure sleeve and thereby moving closure sleeve 348 to its closed position as operating sleeve 380 moves from its first position to its second position.

Pins 386 also serve to hold operating sleeve 380 so that it will not rotate as operating sleeve 380 is later drilled out of mandrel 332 after the cementing job is completed.

Fifth embodiment 330 further includes an internal lower opening sleeve 390 slidably received in bore 338 of mandrel 332 below operating sleeve 380. Opening sleeve 390 may be substantially identical to opening sleeve 94 in first embodiment 10 and second embodiment 150, and opening sleeve 390 is slidable between a closed position as shown in FIG. 5A covering mandrel port 344 and an open position wherein mandrel port 344 is uncovered by opening sleeve 390 as the opening sleeve move downwardly relative to mandrel 332. It is noted that when opening sleeve 390 is in its closed position as shown in FIG. 5A, operating sleeve 380 is simultaneously in its first position, and inner passage 336 of mandrel 332 is in fluid communication with bore 350 of closure sleeve 348 between seals 356 and 358. This is because there is no seal between the lower end of opening sleeve 380 and mandrel 332.

Opening sleeve 390 in the embodiment of FIG. 5A–5B is a plug-operated sleeve having an annular seat 392 defined on its upper end which is constructed for engagement with a pump-down or free-fall plug (not shown) of a kind known in the art. A plurality of shear pins 394 initially hold opening sleeve 390 in its closed position. A sealing means, such as upper and lower O-rings 396 and 398, provides sealing engagement between opening sleeve 390 and bore 338 of mandrel 332 above and below mandrel port 344, respectively, when the opening sleeve is in its closed position.

An anchor ring 400 is disposed in bore 338 of mandrel 332 and is spaced below opening sleeve 390 when the opening sleeve is in its closed position. Anchor ring 400 may be substantially identical to anchor 104 in first embodiment 10 and second embodiment 150. Anchor ring 400 is locked in position by a retainer ring 402. A sealing means, such as O-ring 404, provides sealing engagement between anchor ring 400 and mandrel 332.

When opening sleeve 390 is moved to its open position, as further described herein, it moves downwardly until it abuts anchor ring 400. A lower end 406 of opening sleeve 39 acts as a lug which is received within an upwardly facing recess 408 on anchor ring 400 when the opening sleeve is moved to its closed position. This prevents opening sleeve 390 from rotating relative to anchor ring 400 in mandrel 332 at a later time when the internal components are drilled out of mandrel 332. Similarly, a lug 410 on the upper end of opening sleeve 390 is received within the downwardly facing recess 412 on the lower end of operating sleeve 380 when the opening sleeve is in its open position and the operating sleeve is moved to its second position. This prevents operating sleeve 380 from rotating relative to opening sleeve 390 in mandrel 332 at a later time when the internal components are drilled out of the mandrel.

Inflatable packing means 371 includes an upper packer shoe 414 which is attached to check valve retainer 370 at threaded connection 416. A sealing means, such as O-rings 418 and 420, provides sealing engagement therebetween.

A check valve 422 is disposed adjacent to the lower end of check valve retainer 370 and sealingly engages a third outer surface 424 of mandrel 332. Check valve 370 is of a kind known in the art and allows fluid flow downwardly while preventing upward fluid flow.

Inflatable packing means 371 also includes an elastomeric packer element 426 which is disposed around mandrel 332 and attached to upper packer shoe 414.

Referring now to FIG. 5B, the lower end of packer element 426 is connected to a lower packer shoe 428. Lower packer shoe 428 is also a portion of inflatable packing means 371. The lower end of mandrel 332 is connected to lower packer shoe 428 at threaded connection 430. A lower nipple 432 is connected to lower packer shoe 428 at threaded connection 434. The lower end of lower nipple 432 is adapted for connection to lower casing string components.

Packer element 426, lower packer shoe 428 and lower nipple 432 may be substantially identical to the corresponding components described in the other embodiments of the invention.

Sixth Embodiment

Figure 6A:
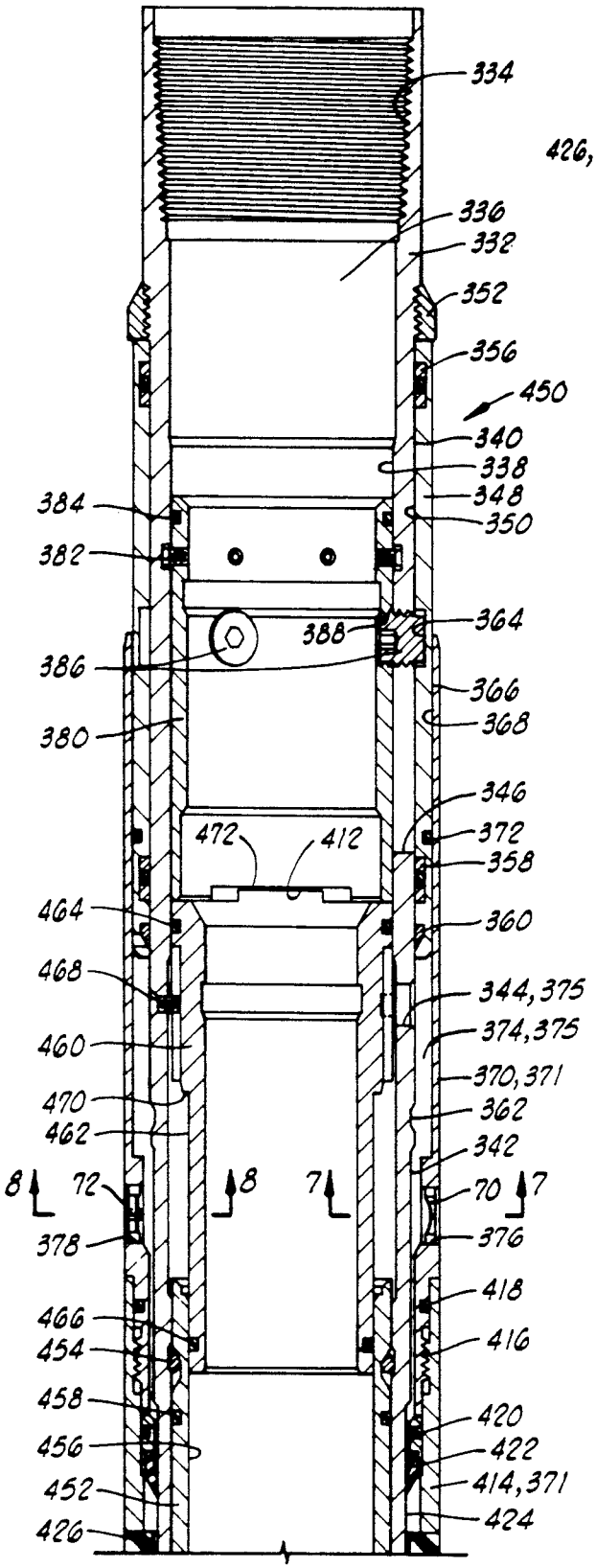
FIGS. 6A and 6B show a sixth embodiment of the invention utilizing a hydraulically operated lower internal opening sleeve.
Figure 6B:
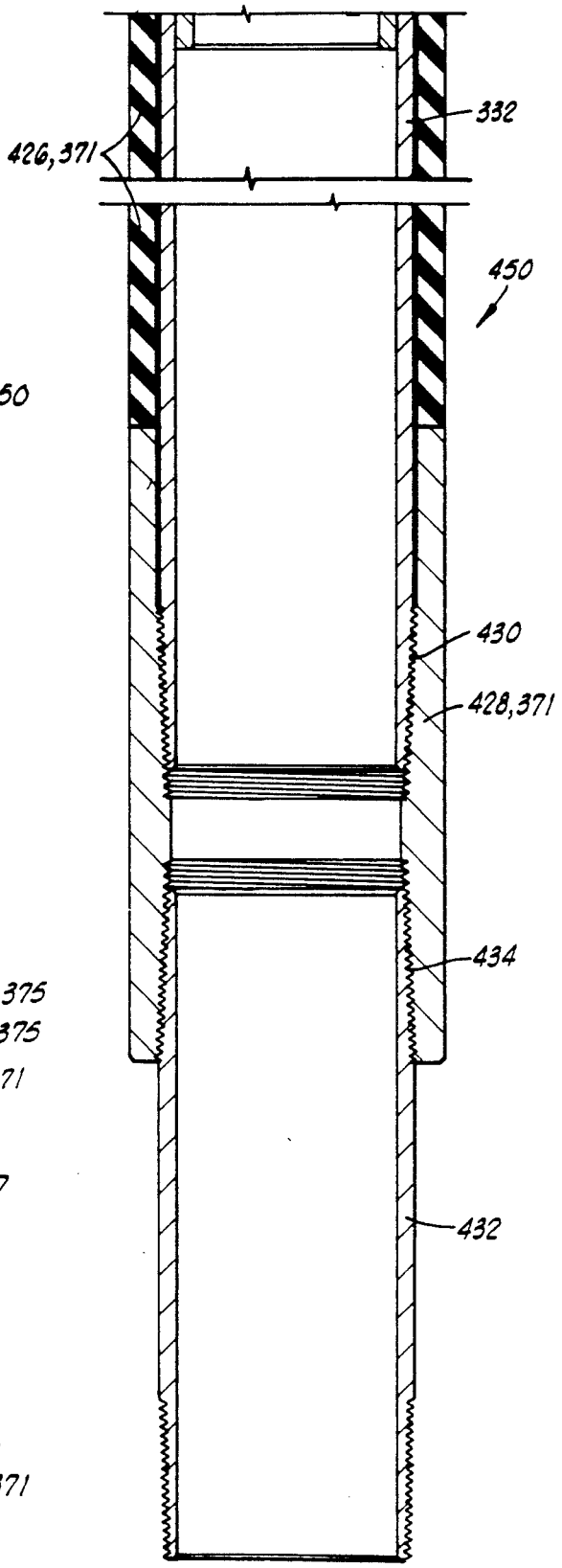

Referring now to FIGS. 6A and 6B, a sixth embodiment of the stage cementer and inflation apparatus of the present invention is shown and generally designated by the numeral 450. Sixth embodiment 450 is virtually the same as fifth embodiment 330 except for the opening sleeve.

An anchor ring 452 is disposed in bore 338 of mandrel 332 and is locked in position by a retainer ring 454.

Anchor ring 452 defines a bore 456 therethrough. A sealing means, such as O-ring 458, provides sealing engagement between anchor ring 452 and mandrel 332.

Sixth embodiment 450 includes a hydraulically operated opening sleeve 460 which has a reduced diameter lower portion 462 which is slidably received within bore 456 of anchor ring 452. An upper sliding sealing means, such as O-ring 464, provides sealing engagement between opening sleeve 460 and bore 338 in mandrel 332, and a lower sealing means, such as O-ring 466, provides sealing engagement between opening sleeve 460 and anchor ring 452. It will be seen by those skilled in the art that when opening sleeve 460 is in its initial, closed position, it covers and sealingly closes mandrel port 344 in mandrel 332 due to the action of seals 464 and 466 and O-ring 458 which seals between anchor ring 452 and bore 338 of mandrel 332.

Opening sleeve 460 is initially held in this closed position by a plurality of shear pins 468.

As is further described herein, a high pressure can be applied to inner passage 336 through mandrel 332, and this pressure will act downwardly on the differential area between O-rings 464 and 466 until the force exceeds that which can be held by shear pins 468. Shear pins 468 then shear, and the downwardly acting differential pressure will move opening sleeve 460 downwardly until a shoulder 470 thereon engages anchor ring 452.

However, if the predetermined pressure if not attainable, opening sleeve 460 may be opened using a pump-down or free-fall plug to move the opening sleeve to its open position in a manner substantially identical to opening sleeve 39 in fifth embodiment 330.

Opening sleeve 460 has an upwardly extending lug 472 which will be received by downwardly facing recess 412 in operating sleeve 380 when opening sleeve 460 is in its open position and operating sleeve 380 is moved to its second position. Non-rotating engagement is provided between shoulder 470 of opening sleeve 460 in the upper end of anchor ring 452 by a similar lug and recess type interlocking structure (not shown). This interlocking prevents operating sleeve 380 from rotating relative to opening sleeve 460 and prevents opening sleeve 460 from rotating relative to anchor ring 452 in mandrel 332 at a later time when the internal components are drilled out of mandrel 332.

Operation Of The Fifth And Sixth Embodiments

Either fifth embodiment 330 or sixth embodiment 450 of the stage cementer and inflation packer is made up as part of the casing string which is run into the well bore in a manner known in the art. Depending upon the embodiment, the apparatus is in the configuration shown in FIGS. 5A and 5B or FIGS. 6A and 6B when run into the well bore.

As apparatus 330 or 450 is run into the hole, the pressure in the well annulus and the pressure in annulus 374 in the tool is equalized through pressure equalizing means 72. Fluid in the well bore will pass through openings 80 in valve body 78 and deflect valve member 82 inwardly (see FIG. 8). This prevents premature rupturing of rupture disc 74 (see FIG. 7).

Cementing of the first or bottom stage below apparatus 330 or 450 is carried out in a manner known in the art. This places cement below the casing in the well bore at a location below apparatus 330 or 450.

After the first stage cementing operation is completed, the opening sleeve is actuated. In the fifth embodiment of FIGS. 5A and 5B, this is accomplished by dropping into the casing a pump-down or free-fall opening plug (not shown) of a kind known in the art. The opening plug engages annular seat 392 in opening sleeve 390.

Pressure is then applied to the casing which forces the opening plug against opening sleeve 390, thereby shearing shear pins 394 and moving opening sleeve 390 downwardly from its closed position until lower end 40 thereof contact anchor ring 400. This places opening sleeve 390 in its open position, and it will be seen by those skilled in the art, that mandrel port 344 is thus opened and placed in communication with inner passage 336 in mandrel 332.

In sixth embodiment 450, a pump-down or free-fall plug is not required. Rather, pressure is increased within the casing string and thus within sixth embodiment apparatus 450 which acts against the differential area defined on opening sleeve 460 between O-rings 464 and 466 until shear pins 468 are sheared and opening sleeve 460 is moved downwardly until shoulder 470 thereof contacts anchor ring 452. This places opening sleeve 460 in its open position, and it will be seen by those skilled in the art, that, as with fifth embodiment 330, mandrel port 344 is thus opened and placed in communication with inner passage 336 of mandrel 332. As previously mentioned, a plug may be used to open opening sleeve 460 if the pressure is not sufficiently high.

Thereafter, operation of fifth embodiment 330 and sixth embodiment 450 is identical.

As casing pressure is increased, fluid passes from inner passage 336 through mandrel port 344 into annulus 374. That is, fluid passes from inner passage 336 through inflation passage means 375 to packer element 426. The fluid flows past check valve 422 into the packer portion. Check valve 422 insures that there is no back flow out of the packer portion. As packer element 426 inflates, check valve retainer 370 which is attached to upper packer shoe 414 slides downwardly along outer surface 336 of closure sleeve 348 and also downwardly along mandrel 332, allowing packer element 426 to be brought into sealing engagement with the well bore.

When pressure in the casing, and thus in inner passage 336, reaches a predetermined level, rupture disc 74 of pressure relief means 70 will rupture outwardly. It will be see that this places retainer port 376 in check valve retainer 370 and mandrel port 344 in communication with the well annulus. Then cement for the second stage cementing can be pumped down the casing with the displacing fluids located therebelow being circulated through mandrel port 344, annulus 374 and body port 376 and back up the well annulus. A bottom cementing plug (not shown) may be run below the cement, and a top cementing plug (not shown) is run at the upper extremity of the cement, in a manner known in the art.

The bottom plug, if any, will seat against operating sleeve 380, and further pressure applied to the cement column will rupture a rupture disc in the bottom cementing plug. The cement will then flow through the bottom cementing plug and through mandrel port 344, annulus 374, and body port 376 and upwardly through the well annulus.

When the top cementing plug seats against the bottom cementing plug, the second stage of cementing is terminated. Further pressure applied to the casing forces the top and bottom cementing plugs against operating sleeve 380, forcing it downwardly from its first position to its second position. Because of the mechanical interlocking by pins 386 between operating sleeve 380 and closure sleeve 348, closure sleeve 348 is moved downwardly from its open to closed position as operating sleeve 380 is moved downwardly from its first to its second position. As this occurs, lower seal 358 in closure sleeve 348 is moved below mandrel port 344, thus sealingly separating mandrel port 344 from retainer port 376. It will be seen by those skilled in the art that fluid may then no longer flow through mandrel port 344 and out body port 376 into the well annulus. Outer surface 366 of closure sleeve 348 slides downwardly within bore 368 in check valve retainer 370. Downward movement of operating sleeve 380 and closure sleeve 348 stops when retainer ring 360 carried by the closure sleeve is aligned with retainer ring groove 362 in mandrel 332.

Subsequent to this cementing operation, the upper and lower cementing plugs, operating sleeve 380, opening sleeve 390 or 460, and anchor ring 400 or 452 can all be drilled out of mandrel 332 leaving a smooth bore through the apparatus. Components to be drilled out may be made of easily drillable material such as aluminum. Since all of the components are non-rotatably locked to each other and to mandrel 332, as previously described, the drilling out of the components is further aided.

It can be seen, therefore, that the stage cementer and inflation packer apparatus of the present invention is well adapted to carry out the ends and advantages mentioned as well as those inherent therein. While several presently preferred embodiments of the apparatus are shown for the purposes of this disclosure, numerous changes in the arrangement and construction of parts may be made by those skilled in the art. All such changes are encompassed within the scope and spirit of the appended claims.

What is claimed is:

1. A cementing tool apparatus for use in a well bore, said apparatus comprising:

a mandrel having an inner passage defined therethrough and having an outer surface;

inflatable packing means, connected to said mandrel, for sealingly engaging the well bore;

inflation passage means for providing communication between said inner passage in said mandrel and said packing means when opened;

an opening sleeve slidably received in said mandrel and movable between a closed position wherein said inflation passage means is closed and an open position wherein said inflation passage means is open;

pressure relief means upstream of said packing means for opening in response to a predetermined pressure after inflation of said packing means and thereby placing said inner passage in said mandrel in communication with a well annulus;

an outer closure sleeve slidably received about said outer surface of said mandrel and movable between an open position wherein said pressure relief means provides communication between said inner passage and said well annulus when said pressure relief means is open and a closed position wherein communication between said inner passage and said well annulus is prevented;

an inner operating sleeve slidably received in said mandrel and movable between first and second positions relative to said mandrel; and interlocking means operably associated with both said operating sleeve and said closure sleeve for transferring a closing force from said operating sleeve to said closure sleeve and thereby moving said closure sleeve to its closed position as said operating sleeve moves from its first position to its second position.

2. The apparatus of claim 1 wherein said inflation passage means comprises a port defined through a wall of said mandrel.

3. The apparatus of claim 2 wherein said port is aligned with said pressure relief means.

4. The apparatus of claim wherein said inflation passage means comprises a slot defined in said opening sleeve.

5. The apparatus of claim wherein said pressure relief means comprises rupture means for rupturing in response to said predetermined pressure.

6. The apparatus of claim 5 wherein said rupture means comprises a rupture disc.

7. The apparatus of claim 1 wherein said pressure relief means is disposed in a port defined in said outer closure sleeve.

8. The apparatus of claim wherein said pressure relief means is disposed in a port defined in said mandrel.

9. The apparatus of claim further comprising a housing; and wherein at least a portion of said outer closure sleeve is slidably received in said housing.

10. The apparatus of claim 9 wherein:

said housing defines a housing port therein; and said pressure relief means is disposed in said housing port.

11. The apparatus of claim 1 wherein said inflatable packing means is disposed around an outer surface of said mandrel.

12. The apparatus of claim 1 wherein said mandrel comprises:

an upper mandrel;

a lower mandrel; and connecting means for interconnecting said upper and lower mandrels.

13. The apparatus of claim 12 wherein:

said opening sleeve is slidably received in said upper mandrel;

said outer closure sleeve is slidably received about said upper mandrel;

said inner operating sleeve is slidably received in said upper mandrel; and said inflatable packing means is disposed about said lower mandrel.

14. The apparatus of claim 13 wherein said lower mandrel and inflatable packing means are one set of a plurality of interchangeable sets of lower mandrels and inflatable packing means.

15. The apparatus of claim 1 wherein:

said mandrel defines a slot therein; and said interlocking means comprises a pin extending through said slot and fixedly connected to both said outer closure sleeve and said inner operating sleeve.

16. The apparatus of claim 1 further comprising check valve means between said inflation passage means and said inflatable packing means for allowing movement of fluid to said packing means while preventing deflation thereof.

17. The apparatus of claim 1 further comprising pressure equalizing means for equalizing pressure on an inside portion of said pressure relief means and a well annulus.

18. The apparatus of claim 1 wherein:

said opening sleeve defines a differential pressure area thereon; and a predetermined pressure applied across said differential pressure area moves said opening sleeve from its closed position to its open position.

19. The apparatus of claim further comprising a retainer ring carried by said closure sleeve; and wherein downward movement of said closure sleeve is terminated by engagement of said retainer ring with a retainer ring groove defined in said mandrel.

20. A cementing tool apparatus for use in a well bore, said apparatus comprising:

a mandrel having an inner passage defined therethrough and having an outer surface, said mandrel also defining a mandrel port through a wall thereof;

inflatable packing means, connected to said mandrel, for sealingly engaging the well bore;

an opening sleeve slidably received in said mandrel and movable relative thereto between a closed position wherein said mandrel port is covered by said opening sleeve and an open position wherein said mandrel port is uncovered by said opening sleeve, said inflatable packing means being in communication with said mandrel port when said opening sleeve is in said open position thereof;

an outer closure sleeve slidably received about said outer surface of said mandrel and movable relative thereto between an open position wherein said mandrel port is uncovered by said closure sleeve and a closed position wherein said mandrel port is covered by said closure sleeve;

an inner operating sleeve slidably received in said mandrel and movable relative thereto between first and second positions relative to said mandrel; and interlocking means operably associated with both said operating sleeve and said closure sleeve for transferring a closing force from said operating sleeve to said closure sleeve and thereby moving said closure sleeve to its closed position as said operating sleeve moves from its first position to its second position.

21. The apparatus of claim 20 wherein said mandrel comprises:

an upper mandrel;

a lower mandrel; and connecting means for interconnecting said upper and lower mandrels.

22. The apparatus of claim 21 wherein:

said opening sleeve is slidably received in said upper mandrel;

said outer closure sleeve is slidably received about said upper mandrel;

said inner operating sleeve is slidably received in said upper mandrel; and said inflatable packing means is disposed about said lower mandrel.

23. The apparatus of claim 20 wherein:

said opening sleeve defines a differential pressure area thereon; and a predetermined pressure acting on said differential area moves said opening sleeve from its closed to its open position.

24. A cementing tool apparatus for use in a well bore, said apparatus comprising:

a mandrel having an inner passage defined therethrough and having an outer surface, said mandrel also defining a mandrel port through a wall thereof;

inflatable packing means, connected to said mandrel, for sealingly engaging the well bore;

an opening sleeve slidably received in said mandrel and movable relative thereto between a closed position wherein said mandrel port is covered by said opening sleeve and an open position wherein said mandrel is uncovered by said opening sleeve;

an outer closure sleeve slidably received about said outer surface of said mandrel and movable relative thereto between an open position wherein said mandrel port is uncovered by said closure sleeve and a closed position wherein said mandrel port is covered by said closure sleeve;

an inner operating sleeve slidably received in said mandrel and movable relative thereto between first and second positions relative to said mandrel;

interlocking means operably associated with both said operating sleeve and said closure sleeve for transferring a closing force from said operating sleeve to said closure sleeve and thereby moving said closure sleeve to its closed position as said operating sleeve moves from its first position to its second position; and pressure relief means for opening in response to a predetermined pressure after inflation of said packing means and thereby placing said mandrel port in communication with a well annulus.

25. The apparatus of claim 24 wherein said pressure relief means is aligned with said mandrel port.

26. The apparatus of claim 24 wherein said pressure relief means is disposed in a port defined in said outer closure sleeve.

27. The apparatus of claim 24 wherein said pressure relief means is characterized by a rupture disc.

28. The apparatus of claim 24 further comprising pressure equalizing means for equalizing a pressure on an inner portion of said pressure relief means and a well annulus.

29. The apparatus of claim 28 wherein said pressure equalizing means is disposed in a port defined in said outer closure sleeve.

30. The apparatus of claim 24 further comprising a housing defining a housing port therethrough; and wherein said pressure relief means is disposed in said housing port.

31. The apparatus of claim 30 wherein said housing forms an upper end of said inflatable packing means.

32. The apparatus of claim 30 wherein said outer closure sleeve is slidably received in said housing.

33. The apparatus of claim 30 further comprising pressure equalizing means for equalizing a pressure on an inner portion of said pressure relief means and a well annulus.

34. The apparatus of claim 33 wherein said pressure equalizing means is disposed in a second housing port defined in said housing.

35. A cementing tool apparatus for use in a well bore, said apparatus comprising:

a mandrel having an inner passage defined therethrough and having an outer surface, said mandrel also defining an inflation port and a cementing port therein;

inflatable packing means, connected to said mandrel and in communication with said inflation port, for sealingly engaging the well bore when inflated;

an opening sleeve slidably received in said mandrel and movable relative thereto between a closed position wherein communication between said inflatable packing means and said inner passage through said inflation port is prevented and an open position wherein said inflatable packing means and said inner passage are in communication through said inflation port;

pressure relief means disposed in said cementing port for opening in response to a predetermined pressure after inflation of said packing means and thereby placing said inner passage in said mandrel in communication with a well annulus;

an outer closure sleeve slidably received about said outer surface of said mandrel and movable relative thereto between an open position wherein said cementing port is uncovered by said closure sleeve and a closed position wherein said cementing port is covered by said closure sleeve;

an inner operating sleeve slidably received in said mandrel and movable relative thereto between first and second positions; and means for transferring a closure force from said operating sleeve to said closure sleeve and thereby moving said closure sleeve from its open to its closed position as said operating sleeve moves from its first position to its second position.

36. The apparatus of claim 35 wherein said cementing port is covered on an inner side thereof by said opening sleeve when in its closed position and said cementing port is uncovered on its inner side when said opening sleeve is in its open position.

37. The apparatus of claim 35 wherein said pressure relief means comprises a rupture disc.

38. The apparatus of claim 35 wherein:

said mandrel defines a slot therein; and said means for transferring comprises a pin extending through said slot and fixedly connected to both said outer closure sleeve and said inner operating sleeve.

39. The apparatus of claim 35 further comprising check valve means between said inflation port and said inflatable packing means for allowing movement of fluid to said packing means while preventing deflation thereof.

40. The apparatus of claim 35 wherein:

said mandrel defines a recess therein;

said opening sleeve defines a slot therein in communication with said recess and said inflation port;

communication between said runner passage and said recess is prevented when said opening sleeve is in said closed position thereof; and said inner passage and said recess are in communication when said opening sleeve is in said open position thereof.

41. The apparatus of claim 35 further comprising pressure equalizing means for equalizing a pressure between an inner portion of said pressure relief means and a well annulus.

42. The apparatus of claim 41 wherein said pressure equalizing means is disposed in another port defined in said mandrel.

43. The apparatus of claim 35 wherein:

said opening sleeve defines a differential pressure area thereon; and a predetermined pressure applied to said differential pressure area moves said opening sleeve from said closed position thereof to its open position.

44. A cementing tool apparatus for use in a well bore, said apparatus comprising:

a mandrel having an inner passage defined therethrough and having an outer surface, said mandrel also defining a mandrel port through a wall thereof and further defining a retainer ring groove therein;

inflatable packing means, connected to said mandrel, for sealingly engaging the well bore;

an opening sleeve slidably received in said mandrel and movable relative thereto between a closed position wherein said mandrel port is covered by said opening sleeve and an open position wherein said mandrel port is uncovered by said opening sleeve;

an outer closure sleeve slidably received about said outer surface of said mandrel and movable relative thereto between an open position wherein aid mandrel port is uncovered by said closure sleeve and a closed position wherein said mandrel port is covered by said closure sleeve;

an inner operating sleeve slidably received in said mandrel and movable relative thereto between said first and second positions relative to said mandrel;

interlocking means operably associated with both said operating sleeve and said closure sleeve for transferring a closing force from said operating sleeve to said closure sleeve and thereby moving said closure sleeve to its closed position as said operating sleeve moves from its first position to its second position; and a retainer ring carried by said closure sleeve, wherein downward movement of said closure sleeve is terminated when said retainer ring is aligned with said retainer ring groove defined in said mandrel.

* * * * *